US008008620B2

(12) United States Patent
Ikeda et al.

(10) Patent No.: US 8,008,620 B2
(45) Date of Patent: Aug. 30, 2011

(54) SUBSTRATE FOR MASS SPECTROMETRY AND MASS SPECTROMETRY METHOD

(75) Inventors: Morihito Ikeda, Ashigarakami-gun (JP); Naoki Murakami, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 151 days.

(21) Appl. No.: 12/568,197

(22) Filed: Sep. 28, 2009

(65) Prior Publication Data

US 2010/0078552 A1 Apr. 1, 2010

(30) Foreign Application Priority Data

Sep. 26, 2008 (JP) ..... 2008-247800

(51) Int. Cl.
*H01J 49/26* (2006.01)

(52) U.S. Cl. ..... 250/288

(58) Field of Classification Search ..... 250/288
See application file for complete search history.

(56) References Cited

U.S. PATENT DOCUMENTS

| | | | | |
|---|---|---|---|---|
| 6,242,264 | B1 * | 6/2001 | Natan et al. | 436/171 |
| 7,517,496 | B2 * | 4/2009 | Pohl | 422/69 |
| 7,579,588 | B2 | 8/2009 | Naya et al. | |
| 7,586,091 | B2 | 9/2009 | Takahashi et al. | |
| 2006/0214101 | A1 | 9/2006 | Takahashi et al. | |

FOREIGN PATENT DOCUMENTS

| | | | |
|---|---|---|---|
| EP | 2 053 383 | A1 | 4/2009 |
| JP | 2001-009800 | A | 1/2001 |
| JP | 2001-138300 | A | 5/2001 |

OTHER PUBLICATIONS

E.P. Go et al., "Desorption/Ionization on Silicon Nanowires", Analytical Chemistry, Mar. 15, 2005, pp. 1641-1646, vol. 77, No. 6.
J. Christopher Love et al., "Self-Assembled Monolayers of Thiolates on Metals as a Form of Nanotechnology", Chemical Review, Mar. 25, 2005, pp. 1103-1169, vol. 105.
Trent R. Northen et al., "Clathrate Nanostructures for Mass Spectrometry", Nature, Supplementary Information, 2007, pp. 1033-1037, vol. 449.
Hideki Masuda, "Preparation of Mesoporous Alumina by Anodic Oxidation and its Application as Functional Material", Material Technology, 1997, pp. 341-346, vol. 15, No. 10.

* cited by examiner

*Primary Examiner* — Kiet T Nguyen
(74) *Attorney, Agent, or Firm* — Sughrue Mion, PLLC

(57) ABSTRACT

A substrate for mass spectrometry includes a first reflective member that is semi-transmissive/semi-reflective, a transparent member, and a second reflective member that is reflective, sequentially provided to form an optical resonator. The optical resonator includes, on a surface of the first reflective member, a sample separation portion at which surface interaction occurs with a plurality of analytes contained in a sample liquid. The analytes are separated on the sample separation portion to perform mass spectrometry on each of the analytes. A sample in contact with the surface of the first reflective member is irradiated with laser beam L to generate resonance in the optical resonator, and an electric field on the surface of the first reflective member is enhanced by the resonance. The enhanced electric field is utilized to ionize analytes S in the sample and to desorb the analytes S from the surface.

28 Claims, 10 Drawing Sheets

SUBSTRATE FOR MASS SPECTROMETRY AND MASS SPECTROMETRY METHOD

BACKGROUND OF THE INVENTION

1. Field of the Invention

The present invention relates to a substrate (base plate) for mass spectrometry and a mass spectrometry method. In the mass spectrometry, a substance fixed (immobilized) on a surface of the substrate is irradiated with a laser beam to be desorbed from the surface, and the desorbed substance is captured to perform mass spectrometry.

2. Description of the Related Art

As an analysis method used to identify a substance or the like, a mass spectrometry method is well known. In the mass spectrometry method, an analyte (a substance to be analyzed, an analysis target) is ionized, and identified based on the mass-to-charge ratio of the analyte. For example, in time-of-flight mass spectrometry (TOF-MS, time-of-flight mass spectroscopy), an ionized analyte is caused to fly for a predetermined distance between high-voltage electrodes, and the mass of the analyte is analyzed based on the time of flight.

As ionization methods that are used in the mass spectrometry, there are an electric-field desorption method (FD), a fast atom bombardment method (FAB), a matrix-assisted laser desorption ionization method (MALDI), an electrospray ionization method (ESI), and the like. However, since some analytes are easily ionized while some other analytes are not easily ionized, if ionization process is performed on a mixture of such analytes to ionize the analytes that have different ionization characteristics from each other at the same time, the sensitivity of detecting the analyte that is not easily ionized is lower than the sensitivity of detecting the analyte that is easily ionized. Consequently, a problem of non-uniform detection occurs. Therefore, LC-ESI, in which a liquid chromatography (LC) and the ESI are combined, is generally used as a method for performing mass spectrometry after a plurality of analytes are separated from each other. However, in the LC-ESI, only an analyte that has passed through an LC column is ionized. Therefore, an analysis time period is long, and loss of the analyte occurs due to adsorption of the analyte to the column. To solve such problems, U.S. Patent Application Publication No. 20060214101 and "Desorption/Ionization on Silicon Nanowires", E. P. Go et al., Analytical Chemistry, Vol. 77, pp. 1641-1646, 2005 propose methods for performing mass spectrometry without loss and in a short time period by separating the analytes and by directly irradiating the separation area with a laser beam.

However, in these methods for mass spectrometry, a high-power laser beam is necessary to ionize a substance adsorbed on the surface of a substrate and to desorb the substance from the surface of the substrate. If the high-power laser beam is used, there is a risk that the analyte is damaged. Further, since a high-power light source is needed to irradiate the analyte with the high-power laser beam, there is a problem that the cost of the apparatus becomes high. Further, as a method for desorbing the analyte by using a weak laser beam, a method of spraying a matrix material onto the surface of the substrate after separating the analytes has been proposed. However, in the method, the analytes are spread and blurred by application of the matrix material. Therefore, the separation condition of the analytes deteriorates.

U.S. Pat. No. 7,579,588 proposes an analysis method and apparatus using a substrate for mass spectrometry that includes a rough metal surface on the surface of the substrate. The rough metal surface can generate localized plasmons, and avoid irradiation with a high-power laser beam to desorb the analyte from the substrate. In this method, the low-power laser beam can desorb/ionize the analytes without damaging the analytes. However, separation of the analytes, as described above, is impossible.

Further, U.S. Pat. No. 7,586,091 proposes a method for improving the ionization efficiency by plasmons. In this method, a microchip (substrate) including a plurality of columnar members in a sample separation area of the microchip is used. Further, a metal layer is provided on the surfaces of the columnar members. However, improvement of the ionization efficiency by plasmons is neither described in detail nor sufficiently studied.

SUMMARY OF THE INVENTION

In view of the foregoing circumstances, it is an object of the present invention to make it possible to use a low-power laser beam in mass spectrometry, compared with the laser beam used in a conventional method, and to separate analytes from each other. In the mass spectrometry, a substance fixed on a surface of the substrate is irradiated with a laser beam to be desorbed from the surface, and ions of the substance are captured to perform mass spectrometry.

Further, it is another object of the present invention to provide a substrate for mass spectrometry that can use a lower-power laser beam in mass spectrometry and that can separate the analytes from each other.

A first substrate for mass spectrometry according to the present invention is a substrate for mass spectrometry used in a mass spectrometry method in which a substance fixed on a surface of the substrate is irradiated with a laser beam to be ionized and to be desorbed from the surface, and the ionized substance is captured to perform mass spectrometry, the substrate comprising:

a first reflective member (layer) that is semi-transmissive and semi-reflective;

a transparent member (a transparent layer, a light-transmitting layer); and a second reflective member (layer) that is reflective, wherein the first reflective member, the transparent member (or a dielectric) and the second reflective member are sequentially provided from the surface side (the surface irradiated with the laser beam) of the substrate to form an optical resonator that generates resonance in the transparent member by irradiation of a surface of the first reflective member with the laser beam, and wherein the optical resonator includes, on the surface of the first reflective member, a sample separation portion at which surface interaction occurs with a plurality of analytes contained in a sample liquid.

In the specification of the present application, the term "semi-transmissive and semi-reflective" means that a member or a material is both transmissive (transparent) and reflective. The transmittance and the reflectance may be arbitrary values.

Further, it is desirable that the first reflective member has, at least on the surface the first reflective member, an uneven structure including projections and recesses that are smaller than the wavelength of the laser beam, and that the recesses of the uneven structure are continuously connected from a side (edge) of the sample separation portion to the opposite side (edge) of the sample separation portion.

Here, the expression "uneven structure including projections and recesses that are smaller than the wavelength of the laser beam" means that an average size (here, the "size" refers to the maximum width) of the projections and the recesses and an average pitch of the projections and the recesses are less than the wavelength of the laser beam (here, the "recesses" include gaps (openings) that penetrate through the reflective member in the thickness direction of the reflective member).

Further, the first reflective member may be a metal layer that generates localized plasmons by irradiation with the laser beam.

In the embodiment of the substrate of mass spectrometry according to the present invention, the first reflective member may be a metal layer including a multiplicity of non-cohesive metal particles fixed onto a surface of the transparent member.

In the specification of the present application, the term "non-cohesive metal particles" is defined as metal particles that satisfy (1) the metal particles do not associate with each other, and they are apart from each other, or (2) the metal particles bind to each other in a united manner, and the bound metal particles do not return to original state (separate state) after binding.

Further, according to another embodiment of a substrate for mass spectrometry of the present invention, the transparent member is a transparent microporous member including a multiplicity of micropores that have openings on a first-reflective-member-side surface of the transparent member and that have diameters smaller than the wavelength of the laser beam. Further, the transparent microporous member is loaded with metal micro-particles in such a manner that projection portions of the metal micro-particles, the projection portions being larger than the diameters of the multiplicity of micropores, project from the surface of the transparent microporous member, and the first reflective member is a metal layer including the projection portions.

Further, according to another embodiment of a substrate for mass spectrometry of the present invention, the first reflective member is the metal layer including a multiplicity of columnar (column-form, post-form or the like) members that are substantially parallel to each other, and each of which extends in a direction that is not parallel to a surface of the transparent member.

A second substrate for mass spectrometry according to the present invention is a substrate for mass spectrometry used in a mass spectrometry method in which a substance fixed on a surface of the substrate is irradiated with a laser beam to be ionized and to be desorbed from the surface, and the ionized substance is captured to perform mass spectrometry, wherein the surface of the substrate is a rough metal surface that excites localized plasmons by irradiation with a laser beam and that generates a hot spot, and wherein the rough metal surface has a sample separation portion at which surface interaction occurs with a plurality of analytes contained in a sample liquid.

It is desirable that the rough metal surface has an uneven structure including projections and recesses that are smaller than the wavelength of the laser beam on a surface of metal, and that the recesses of the uneven structure are continuously connected from a side of the sample separation portion to the opposite side of the sample separation portion. For example, the rough metal surface may include a multiplicity of micro-projections and micro-recesses on the surface of the metal. Alternatively, the rough metal surface may include a multiplicity of non-cohesive metal particles fixed onto a surface of a dielectric. Further, the rough metal surface may include metal micro-particles loaded into a multiplicity of micropores that are formed on a surface of a dielectric in such a manner that projection portions of the metal micro-particles, the projection portions being larger than the diameters of the multiplicity of micropores, project from the surface of the transparent member.

In the first and second substrates for mass spectrometry of the present invention, it is desirable that the sample separation portion is coated with an organic molecular layer including a surface modification layer that provides a desirable surface property and/or a desorption/ionization-inducing layer that accelerates (promotes) desorption of an analyte attached to the sample separation portion from the sample separation portion and/or that accelerates ionization of the analyte. Further, it is desirable that the thickness of the organic molecular layer is greater than or equal to 0.3 nm and less than or equal to 50 nm. It is more desirable that the thick of the organic molecular layer is greater than or equal to 0.3 nm and less than or equal to 10 nm, and optionally greater than or equal to 0.3 nm and less than or equal to 3 nm. Further, it is desirable that the thickness of the surface modification layer is greater than or equal to 0.3 nm and less than or equal to 3 nm, and optionally greater than or equal to 0.3 nm and less than or equal to 1 nm. Further, it is desirable that the surface modification layer is a self-assembled monolayer. It is desirable that the self-assembled monolayer includes a compound containing a thiol. Meanwhile, it is desirable that the desorption/ionization-inducing layer includes a compound containing a disiloxane.

The mass spectrometry method of the present invention is an analysis method using the aforementioned substrate for mass spectrometry of the present invention. The mass spectrometry method of the present invention includes the steps of:

making the sample liquid that contains the plurality of analytes flow down from a side of the sample separation portion to the opposite side of the sample separation portion on the substrate for mass spectrometry to separate the plurality of analytes so as to be present at different positions from each other on the sample separation portion;

irradiating each of the plurality of separated analytes on the sample separation portion with a laser beam sequentially to ionize each of the analytes and to desorb each of the analytes from the sample separation portion; and capturing each of the ionized analytes to perform mass spectrometry.

Especially, when the surface of the substrate for mass spectrometry is hydrophobic, it is desirable that the sample liquid flows down after the plurality of analytes are dissolved into an organic solvent or mixed with the organic solvent to obtain the sample liquid. Further, the separation pattern of the analytes in the sample separation portion differs depending on the surface of the sample separation portion. Therefore, it is desirable that mass spectrometry is performed on the same sample liquid by using a plurality of substrates for mass spectrometry that have different organic molecular layers from each other.

The first substrate for mass spectrometry of the present invention includes a first reflective member that is semi-transmissive and semi-reflective, a transparent member, and a second reflective member that is reflective, which are sequentially provided to form an optical resonator. Therefore, light that has passed through the first reflective member and entered the transparent member repeats reflection between the first reflective member and the second reflective member, and multiple reflection occurs. This multiple reflection light effectively induces multiple interference, which causes resonance. Further, the resonance effectively enhances the electric field on the surface of the first reflective member that contacts with a sample containing an analyte for mass spectrometry. Therefore, in a spectrometry method, in which the analyte is ionized and desorbed by irradiation with a laser beam, the energy of the laser beam is increased by the enhanced electric field. Hence, it is possible to ionize and to desorb the analyte by irradiation with a low-power laser beam, compared with the conventional method. Since the energy of the laser beam per se can be reduced, damage to the analyte can be prevented, and the cost of the apparatus can be reduced.

Further, a sample separation portion at which surface interaction occurs between the sample separation portion and a plurality of analytes contained in a sample liquid is provided on the surface of the first reflective member. Therefore, it is possible to separate the plurality of analytes contained in the sample liquid to different positions from each other. Since it is possible to prevent fluctuation in the ionization efficiency caused by interference and inhibition between the analytes, high-sensitivity mass spectrometry is possible.

In the second substrate for mass spectrometry of the present invention, the surface of the substrate is a rough metal surface that excites localized plasmons by irradiation with a laser beam and that generates a hot spot. Therefore, it is possible to effectively enhance the electric field on the surface of the substrate. Therefore, in an analysis method, in which the analyte is ionized and desorbed by irradiation with a laser beam, the energy of the laser beam is increased by the enhanced electric field. Hence, it is possible to ionize and to desorb the analyte by irradiation with a low-power laser beam, compared with the conventional method. Since the energy of the laser beam per se can be reduced, damage to the analyte can be prevented, and the cost of the apparatus can be reduced.

Further, a sample separation portion at which surface interaction occurs with a plurality of analytes contained in a sample liquid is provided on the surface of the substrate. Therefore, it is possible to separate the plurality of analytes contained in the sample liquid to different positions from each other. Therefore, it is possible to prevent fluctuation in the ionization efficiency caused by the interference and inhibition between the analytes. Hence, high-sensitivity mass spectrometry becomes possible.

As described above, the substrate for mass spectrometry of the present invention makes it possible to perform mass spectrometry using a low-energy laser beam, and the present invention can provide a mass spectrometry method in which high-sensitivity mass spectrometry is possible.

DESCRIPTION OF THE PREFERRED EMBODIMENTS

First Embodiment of Substrate for Mass Spectrometry

Figure 1A:
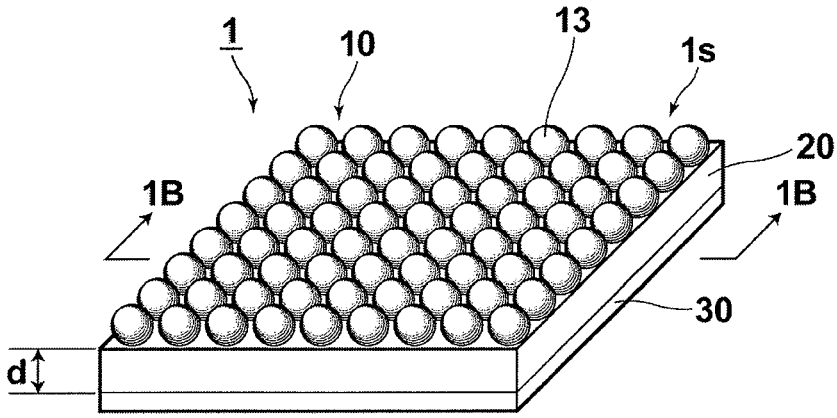
FIG. 1A is a perspective view illustrating a substrate for mass spectrometry according to a first embodiment of the present invention.
Figure 1B:
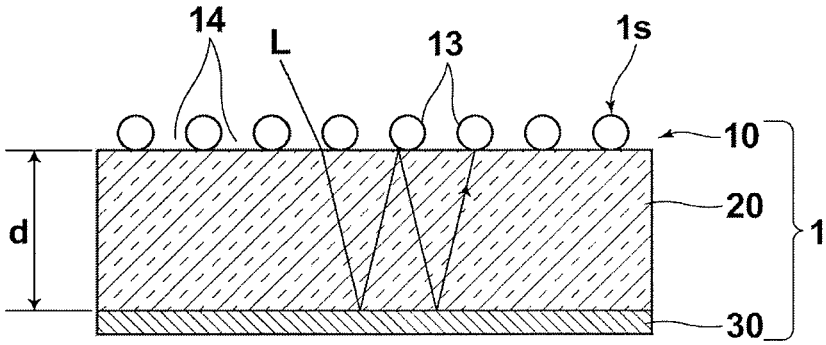
FIG. 1B is a sectional view of the substrate for mass spectrometry according to the first embodiment of the present invention in the thickness direction of the substrate.
Figure 1C:
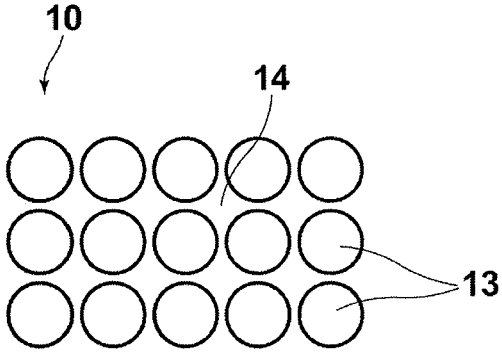
FIG. 1C is a top view of the substrate for mass spectrometry according to the first embodiment of the present invention.

A substrate for mass spectrometry according to a first embodiment of the present invention will be described with reference to FIGS. 1A through 1C. The substrate for mass spectrometry according to the present embodiment forms an optical resonator. FIG. 1A is a perspective view, and FIG. 1B is a sectional view in the thickness direction of the substrate (sectional view along 1B-1B line). FIG. 1C is a schematic top view illustrating the arrangement of metal particles, which will be described later.

As illustrated in FIG. 1A, a substrate 1 for mass spectrometry of the present embodiment has device structure including a first reflective member 10, a transparent member 20, and a second reflective member 30. The first reflective member 10, the transparent member 20, and the second reflective member 30 are sequentially provided from the laser-beam-L-entering side (upper side in FIG. 1A). The first reflective member 10 is semi-transmissive and semi-reflective, and the surface of the first reflective member 10 is a sample contact surface 1*s*. The second reflective member 30 is reflective. Further, the wavelength of the laser beam L is selected based on a substance to be detected.

The transparent member 20 is a transparent flat base plate. The first reflective member 10 is a reflective metal layer, in which a plurality of non-cohesive metal particles 13 are regularly arranged in matrix form and fixed onto the surface of the transparent member 20. The diameters of the metal particles 13 are substantially the same. Further, the second reflective member 30 is a solid metal layer (in which metal is spread without spaces) provided on the other surface of the transparent member 20, which is opposite to the first reflective member 10 side.

The material of the transparent member 20 is not particularly limited. For example, the transparent member 20 may be made of glass, a transparent ceramic, such as alumina, a transparent resin, such as acrylic resins and carbonate resins, or the like.

The material of the first reflective member 10 and the material of the second reflective member 30 may be arbitrary metal that is reflective. For example, the first reflective member 10 and the second reflective member 30 may be made of any one of Au, Ag, Cu, Al, Pt, Ni, Ti, and the alloys thereof, or the like. Each of the first reflective member 10 and the second reflective member 30 may contain two or more kinds of these metals that are reflective.

The second reflective member 30, which is a solid metal layer, is deposited, for example, by metal vapor deposition or the like. Further, the first reflective member 10 may be formed, for example, by performing known photolithography processing after a solid metal layer is deposited by metal vapor deposition or the like.

It is desirable that the plurality of non-cohesive metal particles 13 forming the first reflective member 10 are regularly arranged. As the regularity of the structure (arrangement) is higher, the in-plane evenness of the resonance structure is higher, and that is desirable because the characteristics of the structure are intensified. When the metal particles 13 include cohesive particles, a portion formed by a multiplicity of metal particles cohering to each other and a portion that is not formed by cohesion of the metal particles are present in the first reflective member 10. In such a case, the regularity of the structure of the first reflective member 10 tends to be low. However, in the present embodiment, the metal particles 13 are non-cohesive metal particles. Therefore, it is possible to easily form the first reflective member 10 that has higher structural regularity, compared with a case of including cohesive particles.

Further, since the metal particles 13 are non-cohesive metal particles, they satisfy the following (1) or (2), as described in the "Summary of the Invention" section of this specification:

(1) the metal particles do not associate with each other, and they are apart from each other; and (2) the metal particles bind to each other in a united manner, and the bound metal particles do not return to the original state (separate state) after binding.

An example of the first reflective member 10 formed by fixing the plurality of metal particles 13 of the above definition (1) is a metal layer including the metal particles 13 that are arranged to be apart from each other at least by a certain distance so that the metal particles 13 do not associate with each other. In this metal layer, the metal particles 13 may be randomly arranged. Alternatively, the metal particles 13 may be substantially regularly arranged.

An example of the metal layer in which the metal particles 13 are randomly arranged is an island-pattern metal layer that is obtained by oblique vapor deposition or the like.

The analyte strongly interacts with the surface of the non-cohesive metal particles mainly in a space between the non-cohesive metal particles, such as recesses (gaps) 14 on the surface of the substrate, and the analyte is appropriately separated. Therefore, it is desirable that the metal particles 13 are arranged close to each other.

Figure 10:
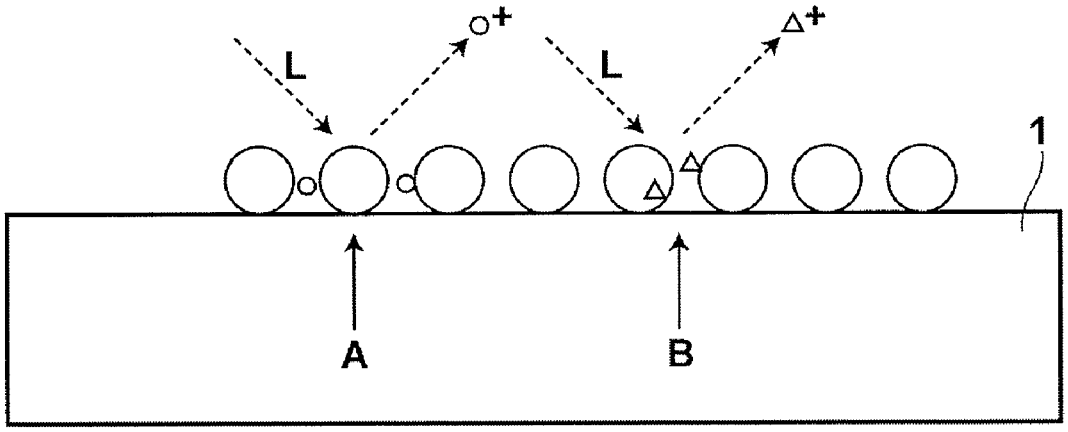
FIG. 10 is a diagram illustrating a way of desorbing analytes by irradiation with laser beams.

The metal layer in which the metal particles 13 are substantially regularly arranged should have an uneven structure, as illustrated in FIG. 10, in which the recesses (gaps) 14 on the surface of the substrate are continuously connected from a side of the substrate to the opposite side of the substrate. For example, the metal particles 13 in dot-form, in bow-tie-array, in needle-form or the like may be provided by patterning so that the metal particles 13 are substantially regularly arranged. In these cases, patterning may be performed by lithography, by processing by using a focused ion beam method (FIB method) or the like. Alternatively, patterning may be performed by utilizing self-assembly or the like.

The first reflective member 10 including the plurality of metal particles 13 of the above definition (2) is formed, for example, by fixing a plurality of metal particles 13 that have been formed in united form in the metal growth process by welding or by plating, and that do not return to the original state (separate state) after binding.

Alternatively, the first reflective member 10 may be formed by applying a dispersion solution of the metal particles 13 to the surface of the transparent member 20 by spin coating or the like and by drying the applied solution. It is desirable that the dispersion solution contains a binder, such as a resin and a protein, so that the metal particles 13 are fixed onto the surface of the transparent member 20 by the binder. When a protein is used as the binder, a bond between proteins may be utilized to fix the metal particles 13 to the surface of the transparent member 20.

The first reflective member 10 is made of a reflective metal. However, since the first reflective member 10 has a plurality of particle gaps 14 (recesses), which are gaps or openings, the first reflective member 10 is semi-transmissive and semi-reflective. The diameter and the pitch of the metal particles 13 are designed so that they are less than the wavelength of the laser beam L. Therefore, the first reflective member 10 has an uneven structure having a pattern that is smaller than the wavelength of the laser beam L. Since the uneven structure of the first reflective member 10 is smaller than the wavelength of the laser beam L, the first reflective member 10 is a semi-transmissive and semi-reflective thinfilm having an electromagnetic mesh shield function.

The pitch of the metal particles 13 is not particularly limited as long as the pitch is smaller than the wavelength of the laser beam L. When visible light is used as the laser beam L, it is desirable that the pitch is, for example, less than or equal to 200 nm. It is desirable that the pitch of the metal particles 13 is as small as possible. Further, the diameter of the metal particles 13 is not particularly limited, but it is desirable that the diameter is as small as possible. It is desirable that the diameter of the metal particle 13 is less than or equal to an average free path of electrons that oscillate in metal by light. Specifically, it is desirable that the diameter of the metal particles 13 is less than or equal to 50 nm, and optionally less than or equal to 30 nm.

The thickness of the transparent member 20 is not limited. It is desirable that the thickness is less than or equal to 300 nm, because when the thickness is in such a range, the number of absorption peak wavelengths in a visible light wavelength range by multiple interference is one, and detection is easy. Further, it is desirable that the thickness is greater than or equal to 100 nm, because when the thickness is in such a range, multiple reflection effectively occurs, and an absorption peak wavelength by multiple interference is easily detected in a visible light range.

The substrate for mass spectrometry of the present embodiment can change the resonance wavelength by changing the thickness of the transparent member 20 and an average refractive index in the transparent member 20. The thickness of the transparent member 20, the average refractive index in the transparent member 20, and the resonance wavelength substantially satisfy the following formula (1). Therefore, when the average refractive index in the transparent member 20 is the same, the resonance wavelength can be changed just by changing the thickness of the transparent member 20.

$$\lambda \approx 2nd/(m+1) \quad (1),$$

(In the formula (I), d is the thickness of the transparent member 20, λ is a resonance wavelength, n is an average refractive index in the transparent member 20, and m is an integer).

In a substrate 2 for mass spectrometry of the second embodiment, which will be described later, the transparent member 20 is made of a transparent microporous material. When the transparent member 20 is the transparent microporous material, the term "average refractive index in the transparent member 20" means an average refractive index obtained by averaging a refractive index of the transparent microporous material and a refractive index of a substance in the micropores of the microporous material (when the micropores are not loaded with any substance, air is in the micropores, and when the micropores are loaded or filled with a substance, the substance is in the micropores, or the substance and air are in the micropores).

Further, when absorption by a material occurs, a complex refractive index is used to represent the refractive index. In the transparent member 20, the imaginary number portion in the complex refractive index is zero. Further, when the transparent member 20 has micropores, the influence of the substance in the micropores is small. Therefore, in the formula (I), the refractive index is represented without an imaginary number portion.

The resonance condition changes by the physical properties and by the surface conditions of the first reflective member 10 and the second reflective member 30. However, the magnitude of change in the resonance condition by these factors is smaller than the influence by the thickness of the transparent member 20 and the average refractive index in the transparent member 20. Therefore, it is possible to determine the resonance wavelength, with accuracy on the order of a few nanometers, by using the above formula (I).

As illustrated in FIG. 1B, when the laser beam L enters the substrate 1 for mass spectrometry, a part of the laser beam L is reflected by surface 1*s* (not illustrated) of the first reflective member 10 depending on the transmittance or reflectance of the first reflective member 10. Further, a part of the laser beam L is transmitted through the first reflective member 10, and enters the transparent member 20. The light that has entered the transparent member 20 repeats reflection between the first reflective member 10 and the second reflective member 30. In other words, the substrate 1 for mass spectrometry has a resonance structure in which multiple reflection occurs between the first reflective member 10 and the second reflective member 30. Therefore, in the transparent member 20, multiple interference occurs by the multiple reflection light. Further, resonance occurs at a specific wavelength that satisfies the resonance conditions, and an absorption characteristic of absorbing light at the resonance wavelength is exhibited. The electric field on the surface of the substrate is enhanced in such a manner to correspond to the absorption characteristic in the inside of the substrate. Therefore, it is possible to obtain an electric field enhancement effect on the surface 1*s* of the first reflective member 10, which is a sample contact surface.

It is desirable that the substrate 1 for mass spectrometry has a substrate structure in which optical impedance matching has been achieved to maximize the number of multiple reflection (finesse) in the transparent member 20. When the substrate is structured in such a manner, the absorption peak becomes sharp, and a more effective electric field enhancement effect is obtained, and that is desirable.

The substrate 1 for mass spectrometry is used in a mass spectrometry method, in which a sample in contact with the surface is of the substrate is irradiated with a laser beam to desorb an analyte S contained in the sample from the surface 1*s* of the substrate, and mass spectrometry is performed on the analyte S. In the substrate 1 for mass spectrometry, an electric field on the surface (sample contact surface) 1*s* of the first reflective member 10 is enhanced by an optical resonance effect induced by irradiation with a laser beam L. Therefore, the energy of the laser beam L is increased on the sample contact surface, and the increased light energy can ionize the analyte S and desorb the analyte S from the sample contact surface 1*s*. In other words, since the enhanced electric field can increase the energy of the laser beam L on the sample contact surface 1*s*, use of a lower-energy laser beam becomes possible. Consequently, the cost of the apparatus can be reduced.

Here, ionization of the analyte S and desorption of the analyte S from the sample contact surface may be performed in such a manner that the analyte S is desorbed from the sample contact surface 1*s* after the analyte S is ionized. Alternatively, the analyte S may be ionized after the analyte S is desorbed from the sample contact surface 1*s*.

Further, in the substrate 1 for mass spectrometry of the present embodiment, when the first reflective member 10 is made of metal having free electrons and has an uneven structure having a pattern of a size that can induce localized plasmons, if a laser beam that includes light having a wavelength that can excite localized plasmons in the first reflective member is output to the first reflective member 10, localized plasmon resonance can occur in the first reflective member 10. In the present embodiment, the first reflective member 10 has an uneven structure that is smaller than the wavelength of the laser beam L. Therefore, it is possible to induce localized plasmons in the first reflective member.

The localized plasmon resonance is a phenomenon in which free electrons of metal resonate with an electric field of light and oscillate, thereby generating an electric field. Particularly, when a metal layer has a micro uneven structure, free electrons in projections of the uneven structure oscillate by resonating with the electric field of light. Consequently, a strong electric field is generated in the vicinity of the projection portions. Therefore, it is possible to effectively induce localized plasmon resonance. In the present embodiment, since the first reflective member 10 has an uneven structure that is smaller than the wavelength of the laser beam L, localized plasmons are effectively induced.

At a wavelength that induces localized plasmon resonance, diffusion (scattering) and absorption of the laser beam L greatly increases, and the electric field on the sample contact surface 1*s* is enhanced in a manner similar to resonance by the aforementioned multiple interference. The wavelength at which the localized plasmon resonance occurs (resonance peak wavelength) and the degree of diffusion and absorption of the laser beam L depend on the size of the projections/recesses on the surface of the substrate 1 for mass spectrometry, the type of the metal, the refractive index of a sample in contact with the surface, and the like.

The absorption peak by multiple interference and the absorption peak by localized plasmon resonance appear at different wavelengths from each other in some cases, or overlap with each other. Even if the wavelength of the laser beam is shifted from the absorption peak wavelength by multiple interference and the absorption peak wavelength by localized plasmon resonance, it is possible to enhance the electric field enhancement effect each other. It is considered that the electric field enhancement effect is enhanced by the interaction of these two phenomena or a phenomenon specific to the structure of the substrate as described above. As described above, in the substrate 1 for mass spectrometry, resonance wavelength λ changes depending on the average refractive index n of the transparent member 20 and the thickness d of the transparent member 20. Therefore, these factors should be changed so that the synergy with the electric field enhancement effect by localized plasmon resonance is maximized.

As described above, the first reflective member 10 can excite localized plasmons on the surface 1*s* of the first reflective member 10. Therefore, it is desirable that the laser beam L includes light having a wavelength that can excite localized plasmons in the first reflective member 10, because the electric field enhancement effect by resonance by multiple reflection and the electric field enhancement effect by localized plasmon resonance are obtained at the same time. Therefore, although the first reflective member 10 and the second reflective member 30 may be made of a reflective material other than metal, it is desirable that the first reflective material 10 is made of metal that can obtain an electric field enhancement effect by localized plasmon resonance.

In the present embodiment, a case in which the first reflective member 10 is a metal layer including a plurality of metal particles 13 that are regularly arranged in matrix form and that have substantially the same diameters has been described. However, the diameters of the metal particles 13 may have distribution. Further, the metal particles 13 may be arranged in an arbitrary pattern, and they may be arranged randomly. However, as the regularity of the structure of the first reflective member 10 is higher, the in-plane evenness of the resonance structure is higher, and that is desirable because the properties of the structure are intensified.

Further, in the substrate 1 for mass spectrometry of the present embodiment, the first reflective member 10 has an uneven structure of projections and recesses on the surface 1*s* of the first reflective member 10, and the uneven structure is formed by a plurality of non-cohesive metal particles 13 that constitute the first reflective member 10 and gaps 14 between the metal particles 13. Further, the recesses (gaps 14) of the uneven structure are continuously connected from a side of the substrate 1 to the opposite side of the substrate 1. The surface 1*s* on which the uneven structure is provided functions as a sample separation portion. In other words, in the present embodiment, the surface 1*s* per se, on which the uneven structure is provided, functions as the sample separation portion.

A sample liquid is dropped onto a side of the sample separation portion, and permeates mainly through the recesses to move toward the opposite side of the sample separation portion. At this time, surface interaction occurs between the surface of the transparent member and the analyte contained in the sample liquid and between the surface of the metal particles and the analyte contained in the sample liquid. The strength of the surface interaction differs depending on the analyte. Since a substance having a lower affinity moves faster, and a substance having a higher affinity moves slower, a plurality of analytes contained in the sample liquid are gradually separated while the sample liquid permeates through the gaps 14. Further, when a predetermined time period has passed after dropping the sample liquid, a substrate on which a plurality of analytes are separated to different positions of the substrate from each other is obtained.

Figure 2:
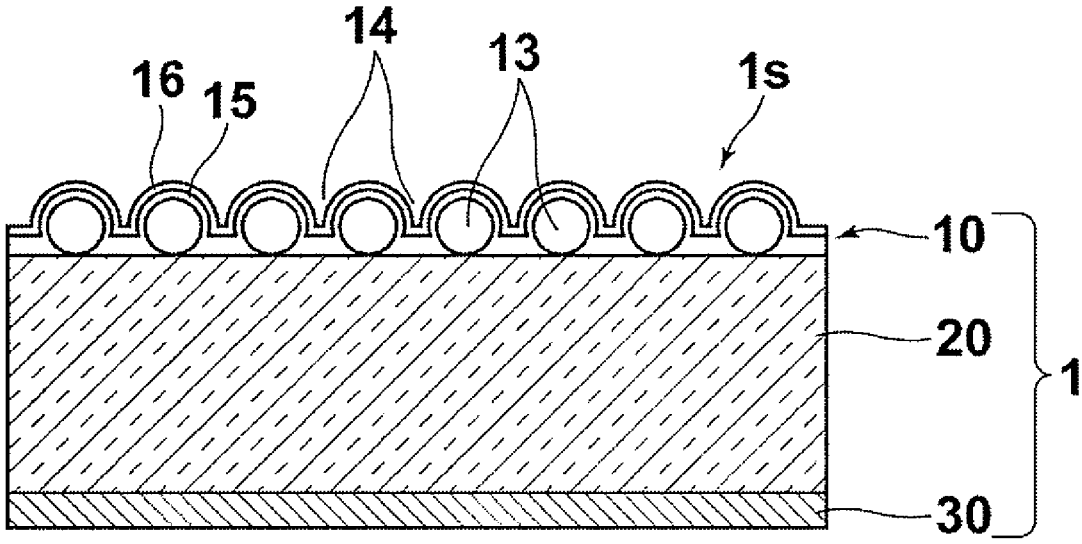
FIG. 2 is a sectional view of a design modification example of the substrate for mass spectrometry according to the first embodiment of the present invention in the thickness direction of the substrate.

As described above, the uneven structure on the surface has a function of separating the analytes contained in the sample liquid. It is desirable that the uneven structure is coated with an organic molecular layer in advance, as illustrated in FIG. 2, to appropriately separate the analytes and to accelerate desorption and ionization.

The organic molecular layer is formed by a surface modification layer 15 and/or a desorption/ionization inducing layer 16. In FIG. 2, both of the surface modification layer 15 and the desorption/ionization inducing layer 16 are provided. Alternatively, only one of the surface modification layer 15 and the desorption/ionization inducing layer 16 may be provided.

The surface modification layer 15 is formed to modify the properties of the surface of the substrate. The surface modification layer 15 can modify the hydrophilicity/hydrophobicity of the surface of the substrate, surface potential, an adsorption characteristic to a specific substance, a liquid lubrication characteristic, an affinity for the desorption/ionization layer, and the like. When the properties of the surface are controlled, the interaction of the surface with the analytes is controlled. Therefore, it is possible to improve the separation performance and/or to modify the separation pattern. For example, when the properties of the surface are changed to hydrophobic or hydrophilic, it is possible to separate the analytes based on the hydrophilicity/hydrophobicity of the analytes. Further, control of the surface properties can control the adsorption characteristic of the surface to the desorption/ionization inducing layer. Therefore, the surface modification layer may be used to form an appropriate desorption/ionization inducing layer.

The organic molecular layers 15 and 16 need to effectively transfer the energy of the enhanced electric field to the analytes. Therefore, it is desirable that the organic molecular layers are not too thick. Specifically, it is desirable that the thickness is in the range of 0.3 nm to 50 nm, and optionally in the range of 0.3 nm to 10 nm, and further optionally in the range of 0.3 nm to 3 nm. Since the surface modification layer 15 should not affect transfer of energy from the enhanced electric field on the surface of the substrate, it is desirable that the thickness of the surface modification layer 15 is as thin as possible so that the transfer of the energy is not prevented. Specifically, it is desirable that the thickness of the surface modification layer 15 is in the range of 0.3 nm to 3 nm, and optionally, in the range of 0.3 nm to 1 nm.

The surface modification layer 15 should be appropriately selected based on the kind of the surface of the substrate. For example, when the surface is metal, a self-assembled monolayer (layer) for the surface of the metal may appropriately be used. A method for coating the metal layer with the self-assembled monolayer may be any known method, such as a method reported in "Self-Assembled Monolayers of Thiolates on Metals as a Form of Nanotechnology", J. C. Love et al., Chemical Review, Vol. 105, pp. 1103-1169, 2005, for example.

Specifically, when gold, silver or platinum is used as the metal layer on the surface of the substrate, a compound represented by general formula (I) X—R—Y and/or general formula (II) $Y_1$—$R_1$—Z—$R_2$—$Y_2$ may be used alone, or at least two kinds of such compounds may be mixed and used. Hereinafter, the components X, R (hereinafter, R will be used to include the cases of $R_1$ and $R_2$), Y (hereinafter, Y will be used to include the cases of $Y_1$ and $Y_2$), and Z will be described.

X and Z are groups (radicals) that have affinity for metal on the surface of the substrate. Specifically, it is desirable that X is, for example, a thiol (—SH), a nitrile (—CN), an isonitrile, a nitro (—$NO_2$), selenol (—SeH), a trivalent phosphorous compound, an isothiocyanate, a xanthate, a thiocarbamate, a phosphine, a thioic acid, or a dithioic acid (—COSH, —CSSH). It is desirable that Z is, for example, a disulfide (—S—S—), a sulfide (—S—), a diselenide (—Se—Se—), or a selenide (—Se—). These groups (X, Z) are spontaneously adsorbed onto a substrate made of a noble metal, such as gold, and form an ultra-thin coating of a single molecular size.

Y may be selected based on the intended properties of the surface. Specifically, for example, when the properties of the surface should be hydrophobic, an alkyl group, a phenyl group, fluorine, an alkoxy group, a phenoxy group, or the like may be used as Y. In contrast, when the properties of the surface should be hydrophilic, a hydroxyl group, a monosaccharide, an oligosaccharide, a polyethylene glycol group, or the like may be used as Y. Further, when the surface should be positively charged, a chemical structure having an isoelectric point of greater than or equal to pH 7 may be used. Specifically, an amino group, a guanidino group, a nitrogen-containing heterocycle, or the like may be used. In contrast, when the surface should be negatively charged, a chemical structure having an isoelectric point of less than pH 7 may be used. Specifically, a carboxyl group, a phosphoric acid group, a sulfonic acid group, or the like may be used. Further, when an adsorption characteristic to a specific substance should be provided, a chemical structure having an adsorption characteristic may be used. Specifically, a derivative of a metallic chelate compound, such as nitrilotriacetic acid (NTA) and iminodiacetic acid (IDA), or a structure, such as a zinc finger peptide or a coiled-coil forming peptide, that has an adsorption characteristic to a specific DNA (deoxyribonucleic acid) or a specific peptide, may be used. Further, they may be used in combination in accordance with the purpose.

It is desirable that R is an alkyl chain. The alkyl chain may be interrupted by a heteroatom. It is desirable that R is a straight chain (not branched) so as to be densely packed in an appropriate manner. In some cases, R may include a double bond and/or a triple bond. Further, $R_1$ and $R_2$ may be the same, or they may be different from each other. It is desirable that the length of the alkyl chain is greater than or equal to four atoms and less than or equal to 23 atoms. Optionally, the length of the alkyl chain may be greater than or equal to four atoms and less than or equal to 11 atoms. A carbon chain may be excessively fluorinated in some cases.

Specific examples of molecules forming a self-assembled monolayer represented by the general formula (I) X—R—Y are 1-decanethiol, 1-hexanethiol, 1-heptanethiol, 10-carboxy-1-decanethiol, 11-hydroxy-1-undecanethiol, 11-amino-1-undecanethiol, 7-carboxy-1-heptanethiol, 16-mercaptohexadecanoic acid, and the like. It is desirable to use 1-hexanethiol or 1-heptanethiol, because a self-assembled monolayer having an appropriate thickness is formed, and the analytes are easily separated, and compounds are easily handled.

Further, specific examples represented by the general formula (II) $Y_1$—$R_1$—Z—$R_2$—$Y_2$ are 4,4'-dithiodibutyl acid, 11,11'-thiodiundecanoic acid, and the like.

In the present invention, the desorption/ionization-inducing layer 16 contains a compound that has an energy mediating function and/or an ionization acceleration function of accelerating or promoting ionization of the analyte. The energy mediating function gives energy of the enhanced electric field that is generated when a sample is irradiated with light, such as a laser beam, to the sample. As a compound having such functions, a compound having the aforementioned functions may be used alone, or a mixture or a deposited product of the compounds may be used. Specifically, a matrix material (matrix agent) used in a MALDI method (matrix-assisted laser desorption/ionization) may be used. Examples of the matrix material are nicotinic acid, picolinic acid, 3-hydroxypicolinic acid, 3-aminopicolinic acid, 2,5-dihydroxybenzoic acid, α-cyano-4-hydroxycinnamic acid, sinapinic acid, 2-(4-hydroxyphenylazo) benzoic acid, 2-mercaptobenzothiazole, 5-chloro-2-mercaptobenzothiazole, 2,6-dihydroxyacetophenone, 2,4,6-trihydroxyacetophenone, dithranol, benzo [a]pyrene, 9-nitroanthracene, 2-[(2E)-3-(4-tret-butylphenyl]-2-methylprop-2-enylidene]malonon itrile, and the like. In the MALDI method, a sample containing analyte S mixed into a matrix is used, and the analyte S is vaporized together with the matrix by light energy absorbed by the matrix. Further, proton-movement occurs between the matrix and the analyte S, and the analyte S is ionized. In the present invention, it is not necessary that the desorption/ionization-inducing layer per se directly absorbs irradiation light. Therefore, a wider range of compounds may be used in the desorption/ionization-inducing layer. For example, initiator compounds described in Literature: "Clathrate Nanostructures for Mass Spectrometry", T. R. Northen et al., Nature, p. 16 of Supplementary Information, Vol. 449, pp. 1033-1037, 2007 (supplementary information, page 16) may be used in a similar manner. Specifically, bis(tridecafluoro-1,1,2,2,-tetrahydrooctyl)tetramethyl-disiloxane, 1,3-dioctyltetramethyldisiloxane, 1,3-bis(hydroxybutyl)tetramethyldisiloxane, 1,3-bis(3-carboxypropyle)tetramethyldisiloxane, and the like may be used. These compounds are more desirable than the matrix used in the MALDI method, because ions or fragment ions of the compounds per se tend not to be detected. Particularly, it is desirable that a compound containing disiloxane is used, because it has a high desorption/ionization efficiency, and fragment ions tend not to be detected.

The desorption/ionization-inducing layer 16 may also function as a surface modification layer. In other words, a substrate for mass spectrometry, the surface properties of which have been modified by proving the desorption/ionization-inducing layer 16, may be used in a desirable manner. For example, if 1,3-dioctyltetramethyldisiloxane is used to coat the non-cohesive metal particles 13 and the surface of the gaps 14 between the metal particles 13, it is possible to make the surface properties of the substrate hydrophobic in an appropriate degree. Therefore, it is possible to separate the analytes in accordance with the degree of hydrophobicity of each of the analytes. Further, since the coating also functions as a desorption/ionization-inducing layer, it is possible to perform mass spectrometry in an appropriate manner.

Second Embodiment of Substrate for Mass Spectrometry

Figure 3A:
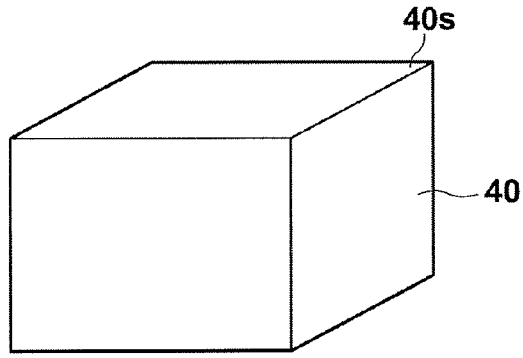
FIG. 3A is a perspective view (No. 1) illustrating the process of producing a substrate for mass spectrometry according to a second embodiment of the present invention.
Figure 3B:
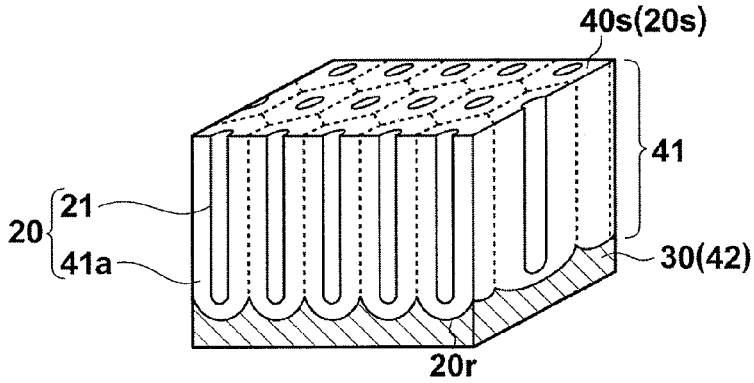
FIG. 3B is a perspective view (No. 2) illustrating the process of producing the substrate for mass spectrometry according to the second embodiment of the present invention.
Figure 3C:
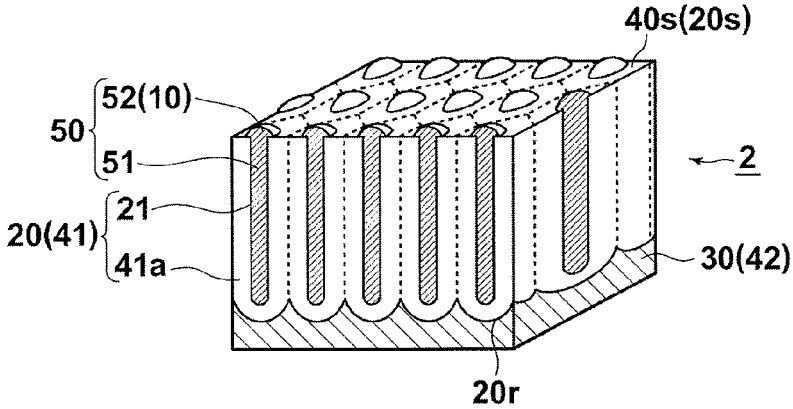
FIG. 3C is a perspective view (No. 3) illustrating the process of producing the substrate for mass spectrometry according to the second embodiment of the present invention.
Figure 3D:
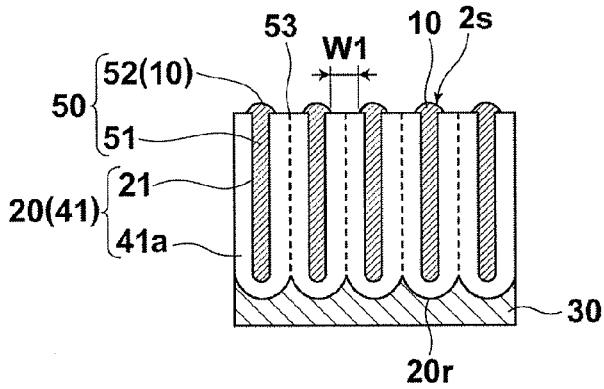
FIG. 3D is a sectional view of the substrate for mass spectrometry according to the second embodiment of the present invention in the thickness direction of the substrate.

With reference to FIGS. 3A through 3D, a substrate for mass spectrometry according to a second embodiment of the present invention will be described. The substrate for mass spectrometry of the present embodiment forms an optical resonator in a manner similar to the first embodiment. FIGS. 3A through 3C are perspective views illustrating the process of producing the substrate for mass spectrometry. FIG. 3D is a sectional diagram illustrating the substrate for mass spectrometry. In the present embodiment, the same reference numerals will be assigned to elements corresponding to the elements of the first embodiment, and explanation of such elements will be omitted.

As illustrated in FIGS. 3C and 3D, a substrate 2 for mass spectrometry of the present embodiment has the first reflective member 10, the transparent member 20 and the second reflective member 30 in a manner similar to the first embodiment. The first reflective member 10, the transparent member 20 and the second reflective member 30 are sequentially provided from the laser-beam-L entering side (upper side in FIGS. 3C and 3D) of the substrate 2 mass spectrometry. The first reflective member 10 is semi-transmissive and semi-reflective, and the surface of the first reflective member 10 is a sample contact surface 2*s*. The second reflective member 30 is reflective.

The present embodiment differs from the first embodiment in that the transparent member 20 is a transparent microporous member, in which a plurality of micropores 21 are formed. The plurality of micropores 21 have openings extending from the first reflective member 10 side of the transparent member 20 toward the second reflective member 30 side of the transparent member 20. The plurality of micropores 21 are open on the first-reflective-member-10-side surface of the transparent member 20, and closed on the second-reflective-member-20-side surface of the transparent member 20. In the transparent member 20, the plurality of micropores 21 are substantially regularly arranged with a diameter and a pitch that are smaller than the wavelength of the laser beam L. The transparent microporous body that forms the transparent member 20 is a metal oxide ($Al_2O_3$) member 41, which is obtained by anodically oxidizing a part of a metal (Al) body 40 to be anodically oxidized. Further, the second reflective member 30 is a non-anodically-oxidized (Al) portion 42 of the metal (Al) body 40 to be anodically oxidized.

In anodic oxidization, the metal body 40 to be anodically oxidized is used as an anode. The anode and a cathode are soaked in an electrolytic solution. Further, a voltage is applied between the anode and the cathode to perform anodic oxidization. The shape of the metal body 40 to be anodically oxidized is not limited. However, it is desirable that the metal body 40 to be anodically oxidized is in plate form, or the like. Further, the metal body 40 to be anodically oxidized may be attached to a support member. For example, the metal body 40 to be anodically oxidized may be deposited, in layer form, on the support member. As the cathode, carbon, aluminum or the like may be used. The electrolytic solution is not limited. It is desirable to use an acid electrolytic solution that contains one kind of acid, or two or more kinds of acid selected from the group consisting of sulfuric acid, phosphoric acid, chromic acid, oxalic acid, sulfamic acid, benzenesulfonic acid, and the like.

When the metal body 40 to be anodically oxidized, illustrated in FIG. 3A, is anodically oxidized, oxidization progresses from the surface 40*s* in a direction substantially perpendicular to the surface 40*s*, and the metal oxide ($Al_2O_3$) member 41, as illustrated in FIG. 3B, is produced. The metal oxide member 41 produced by anodic oxidization has a structure in which a multiplicity of micro columnar bodies 41*a* are arranged without gaps therebetween. Each of the multiplicity of micro columnar bodies 41*a* has a substantially equilateral hexagon form when viewed in a plan-view direction. Further, a micropore 21 that extends substantially straight in a direction perpendicular to the surface 40*s* is formed substantially at the center of each of the micro columnar bodies 41*a*, and the bottom of each of the micro columnar bodies 41*a* is rounded. The structure of the metal oxide object produced by anodic oxidization is described in "Preparation of Mesoporous Alumina by Anodic Oxidization and its Application as Functional Material", H. Masuda, Material Technology, Vol. 15, No. 10, pp. 341-346, 1997, and the like.

When the metal oxide member 41 having a regular arrangement structure is produced, desirable anodic oxidization conditions are, for example, as follows. When oxalic acid is used as the electrolytic solution, the concentration of the electrolytic solution is 0.5 M, the liquid temperature is in the range of 14 to 16° C., application voltage is 40 to 40±0.5 V. Ordinarily, the pitches of the micropores 21 next to each other and the diameters of the micropores 21 can be controlled in the range of 10 to 500 nm and in the range of 5 to 400 nm, respectively. Meanwhile, Japanese Unexamined Patent Publication No. 2001-009800 and Japanese Unexamined Patent Publication No. 2001-138300 disclose methods for more accurately controlling the formation positions of the micropores and the diameters of the micropores. When these methods are used, it is possible to substantially regularly arrange the micropores that have arbitrary diameters and pitches in the aforementioned ranges. When the aforementioned anodic oxidization condition is adopted to produce the metal oxide member 41, micropores 21 that have, for example, diameters of 5 to 200 nm and pitches of 10 to 400 nm are formed.

The substrate 2 for mass spectrometry includes a plurality of metal portions 50, each having a filling portion (insertion portion) 51 and a projection portion 52. The filling portion 51 is loaded or inserted into the micropore 21, in other words, the micropore 21 is filled or loaded with the filling portion 51. The projection portion 52 has a diameter that is larger than the diameter of the filling portion 51, and projects from the surface 20*s* of the transparent member 20 to be formed on the micropore 21. The projection-portion-52-side surface of the metal portion 50 is the surface 2*s* of the first reflective member, which is the sample contact surface. In other words, in the present embodiment, the first reflective member 10 is structured by the projection portions 52 of the plurality of metal portions 50.

The metal portion 50 having the filling portion 51 and the projection portion 52 is formed by performing electroplating or the like on the micropores 21 in the transparent member 20.

When electroplating is performed, the second reflective member 30 functions as an electrode, and metal is preferentially deposited from the bottom of the micropore 21 at which the electric field is strong. Further, when the electroplating is continued, the micropore 12 is filled (loaded) with metal to form the filling portion 51 of the metal portion 50. After the filling portion 51 is formed, electroplating is further continued. Then, the metal overflows from the micropore 21. However, since the electric field in the vicinity of the micropore 21 is strong, the metal continues to be deposited in the vicinity of the micropore 21, and the projection portion 52 is formed on the filling portion 51. The projection portion 52 projects from the surface 20*s* of the transparent member, and the diameter of the projection portion 52 is larger than the diameter of the filling portion 51.

When the metal portion 50 grows by electroplating, a thin layer between the bottom of the micropore 21 and an electric conductor 42, which is formed by a non-anodically-oxidized portion of the metal body 40 to be anodically oxidized, may be broken in some conditions. In such a case, the filling portion 51 of the metal portion 50 may reach the back side 20*r* of the transparent member 20.

The plurality of projection portions 52 forming the first reflective member 10 are close to each other. However, since gaps 53 are provided between the projection portions 52, the first reflective member 10 can transmit light (light-transmissive). Hence, the first reflective member 10 is semi-transmissive and semi-reflective. The surface of the first reflective member 10 includes the projection portions 52 and the gaps 53 between the projection portions 52, and the uneven structure formed by the projection portions 52 and the gaps 53 is smaller than the wavelength of the laser beam L. In the present embodiment, the uneven structure is smaller than the wavelength of light (laser beam L). Therefore, the first reflective member 10 functions as a semi-transmissive/semi-reflective thin layer having an electromagnetic mesh-shield function.

In the substrate 2 for mass spectrometry of the present embodiment, the electric field is enhanced on the surface (sample contact surface) 2*s* of the first reflective member 10 by irradiation with the laser beam L. Therefore, the energy of the laser beam L is increased on the sample contact surface, and the increased light energy can desorb the analyte from the sample contact surface to perform mass spectrometry.

In the present embodiment, the projection portion 52 of the metal portion 50 is in particle form. When the substrate 2 for mass spectrometry is viewed from the upper surface side thereof, a metal particle structure is formed on the surface 20*s* of the transparent member 20. In such a structure, the projection portions 52 are projections of the metal portion 50. Therefore, it is desirable that an average diameter of the projection portions 52 and an average pitch between the projection portions 52 are designed to be less than the wavelength of the laser beam L. In the metal portion 50, it is desirable that the size of the projection portion 52 can excite localized plasmons, because an electric field enhancement effect by localized plasmon resonance can be obtained. When the wavelength of the laser beam L used in the operation is considered, it is desirable that the diameter of the projection portion 52 is greater than or equal to 10 nm and less than or equal to 300 nm.

Further, it is desirable that the projection portions 52 next to each other are apart from each other. It is desirable that an average distance W1 between the adjacent projection portions 52 is in the range of a few nm to 10 nm. When the average distance W1 is in the range of a few nm to 10 nm, a so-called hot spot is formed. The hot spot is a spot in which localized plasmons generated in the vicinities of the projection portions overlap with each other. In the hot spot, an extremely high electric field enhancement effect can be obtained.

The material of the metal portion 50 is not limited. Metal similar to the material of the first reflective member 10 of the first embodiment may be used.

In the present embodiment, when light that has been transmitted through the first reflective member 10 enters the transparent member 20, multiple reflection occurs between the first reflective member 10 and the second reflective member 30 in a manner similar to the first embodiment. Consequently, multiple interference occurs by the multiple reflection light, and resonance occurs at a specific wavelength that satisfies a resonance condition. Light of the resonance wavelength is absorbed by the resonance, and the electric field in the substrate is increased. Therefore, an electric field enhancement effect can be obtained on the sample contact surface 2*s*. The resonance wavelength changes depending on the average refractive index and the thickness of the transparent member 20 in a manner similar to the first embodiment. Therefore, a high electric field enhancement effect (for example, an enhancement effect of 100 times or more) is obtained at a wavelength appropriate for these factors.

In the substrate 2 for mass spectrometry of the present embodiment, the transparent member 20 is a transparent microporous member having a plurality of micropores 21. The plurality of micropores 21 have openings on the first-reflective-member-10-side surface of the transparent member 20. The first reflective member 10 is formed by a plurality of metal portions 50 having the filling portions 51 and the projection portions 52. The filling portions 51 are loaded or filled in the micropores 21, and the projection portions 52 are formed on the filling portions 51 in such a manner to project from the surface 20*s* of the transparent member 20. The diameters of the projection portions 52 are larger than the diameters of the filling portions 51. Except for these features, the basic structure of the substrate 2 for mass spectrometry of the present embodiment is similar to the structure of the first embodiment. Therefore, the substrate 2 for mass spectrometry of the present embodiment can achieve an effect similar to the first embodiment.

The substrate 2 for mass spectrometry of the present embodiment is produced by utilizing anodic oxidization. Therefore, it is possible to easily produce the substrate 2 for mass spectrometry in which the micropores 21 in the transparent member 20 are substantially regularly arranged, and that is desirable. Alternatively, the micropores 21 may be randomly arranged.

In the present embodiment, as the main component of the metal body 40 to be anodically oxidized, which is used in production of the transparent member 20, only Al has been described. However, it is not necessary that the main component is Al. An arbitrary metal may be used as long as the metal can be anodically oxidized, and the metal oxide obtained by anodic oxidization can transmit light (transparent). Metals other than Al are Ti, Ta, Hf, Zr, Si, In, Zn, and the like. The metal body 40 to be anodically oxidized may contain two or more kinds of metals that can be anodically oxidized.

In the present embodiment, the transparent member 20 in which the micropores 21 are substantially regularly arranged is produced by anodic oxidization. However, the method for forming the micropores 21 is not limited to anodic oxidization. The aforementioned embodiment using anodic oxidization is desirable because the entire surface is processed together, and a large area can be processed, and an expensive apparatus is not needed. However, besides the method using the anodic oxidization, a method for forming a plurality of regularly arranged recess portions on the surface of the transparent member 20 by a nanoimprinting technique may be used. Alternatively, the micropores 21 may be formed by a micro processing technique, in which a plurality of regularly arranged recess portions are drawn by electronic drawing techniques, such as a focused ion beam (FIB) and an electron beam (EB), or the like.

In the substrate 2 for mass spectrometry of the present embodiment, the first reflective member 10 is structured by the plurality of projection portions 52 and the gaps 53 between the projection portions 52. The first reflective member 10 has the uneven structure including the projection portions 52 and the gaps 53 on the surface of the first reflective member 10. Further, the recess portions (gaps 53) of the uneven structure are continuously connected from a side of the substrate to the opposite side of the substrate. The surface of the substrate on which the uneven structure is provided functions as a sample separation portion. Therefore, an effect similar to the first embodiment can be obtained.

Further, when an organic molecular layer is formed on the surface of the substrate in a manner similar to the first embodiment, it is possible to improve the functions of separation, desorption and ionization, and that is desirable.

Third Embodiment of Substrate for Mass Spectrometry

Figure 4:
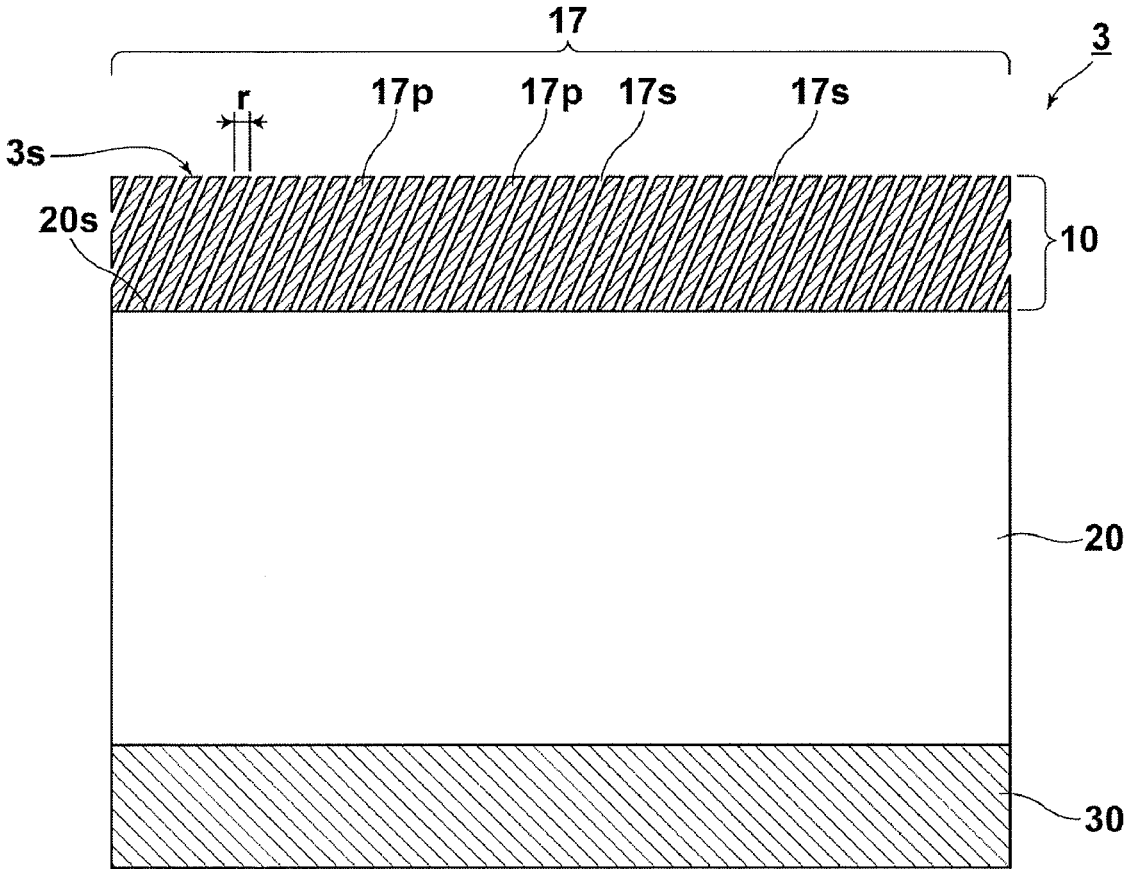
FIG. 4 is a sectional view of a substrate for mass spectrometry according to a third embodiment of the present invention in the thickness direction of the substrate.

With reference to FIG. 4, a substrate for mass spectrometry according to a third embodiment of the present invention will be described. FIG. 4 is a sectional diagram of the substrate for mass spectrometry. The substrate for mass spectrometry according to the third embodiment forms an optical resonator in a manner similar to the substrates for mass spectrometry according to the first embodiment and the second embodiment. In the present embodiment, same reference numerals will be assigned to elements corresponding to the elements of the first embodiment, and explanation of the elements will be omitted.

As illustrated in FIG. 4, a substrate 3 for mass spectrometry of the present embodiment has the first reflective member 10, the transparent member 20 and the second reflective member 30 in a manner similar to the first embodiment. The first reflective member 10, the transparent member 20 and the second reflective member 30 are sequentially provided from the laser-beam-L entering side (upper side in FIG. 4) of the substrate 3 mass spectrometry. The first reflective member 10 is semi-transmissive and semi-reflective, and the surface of the first reflective member 10 is a sample contact surface 3*s*. The second reflective member 30 is reflective.

In the present embodiment, the structure of the first reflective member 10 differs from the first embodiment. In the present embodiment, the first reflective member 10 includes a columnar structure thinfilm 17 having a multiplicity of columnar members 17*p*. The multiplicity of columnar member 17*p* are substantially parallel to each other and extend in a direction non-parallel to the surface 20*s* of the transparent member 20.

The columnar structure thinfilm 17 is a metal layer, and the material of the columnar structure thinfilm 17 is not limited as long as it is metal. Metal similar to the reflective member 10 of the first embodiment may be used. Although the columnar structure thinfilm 17 is a metal layer, since a plurality of gaps 17*s* are present between the columnar member 17*p* next to each other, the columnar structure thinfilm 17 transmits light (transparent). Therefore, the columnar structure thinfilm 17 is semi-transmissive and semi-reflective. In the present embodiment, the column diameter r of the columnar member 17*b* and the density of the gaps 17*s* are designed so that the first reflective member 10 has, on the surface of the first reflective member 10, an uneven structure that is smaller than the wavelength of the laser beam L. In the present embodiment, the uneven structure is smaller than the wavelength of light. Therefore, the metal columnar structure thinfilm 17 functions as a semi-transmissive/semi-reflective thinfilm that has an electromagnetic mesh shield function.

The method for forming (depositing) the columnar structure thinfilm 17 is not particularly limited. For example, the columnar structure thinfilm 17 may be deposited by using a gas phase growth method (vapor phase growth method), such as a CVD (chemical vapor deposition) method and a sputtering method. The multiplicity of columnar members 17*p* forming the columnar structure thinfilm 17 should extend in a direction non-parallel to the surface 20*s* of the transparent member 20. It is desirable that the multiplicity of columnar members 17*p* extend in directions within 90±15° with respect to the surface 20*s* of the transparent member 20, and optionally in directions within 90±10° with respect to the surface 20*s* of the transparent member 20. When the columnar structure thinfilm 17 is deposited by using the aforementioned deposition methods, if the columnar structure thinfilm 17 is deposited in such a manner that the multiplicity of columnar members 17*p* extend at 90° with respect to the surface 20*s* of the transparent member 20, the gaps tend to be filled and lost. Therefore, it is desirable that the columnar members 17*p* grow in directions other than 90°. Hence, it is desirable that the columnar structure thinfilm 17 is deposited by using an oblique vapor deposition method. Further, it is necessary that the gaps 17*s* between the columnar members 17*p* are continuously connected at least in a permeation direction of the sample to make the columnar structure thinfilm 17 function as a sample separation portion.

The thickness of the columnar structure thinfilm 17 is not limited as long as the columnar structure thinfilm 17 is semi-transmissive and semi-reflective. Further, the length of the columnar member 17*p* is not particularly limited. However, when the length of the columnar member 17*p* is in the range of 30 to 500 nm, it is possible to obtain a semi-transmissive/semi-reflective columnar structure thinfilm 17 that has sufficient gaps 17*s* at any angle of the growth of the columnar member 17*p* with respect to the surface 20*s* of the transparent member 20.

In the substrate 3 for mass spectrometry of the present embodiment, the electric field is enhanced on the surface (sample contact surface) 3*s* of the first reflective member 10 by irradiation with the laser beam L. Therefore, the energy of the laser beam L is increased on the sample contact surface, and the increased light energy can desorb the analyte S from the sample contact surface to perform mass spectrometry.

The diameter r of the columnar member 17*p* and the density of the gaps 17*s* are not particularly limited as long as the first reflective member 10 has an uneven pattern that is smaller than the wavelength of the laser beam L. When visible light is used as the laser beam L, it is desirable that the uneven pattern of 200 nm or less is formed. In the present embodiment, it is desirable that the gaps 17*s* are substantially evenly distributed in the first reflective member 10, because as the degree of the structure regularity is higher, the in-plane evenness of the resonance structure is higher. The diameter of the columnar member 17*p* is not particularly limited, but it is desirable that the diameter is smaller. It is desirable that the diameter of the columanr member 17*p* is less than or equal to an average free path of electrons that oscillate in metal by illumination with light. Specifically, it is desirable that the diameter of the columnar member 17*p* is less than or equal to 50 nm, and optionally less than or equal to 30 nm.

In the present embodiment, when light that has been transmitted through the first reflective member 10 enters the transparent member 20, multiple reflection occurs between the first reflective member 10 and the second reflective member 30 in a manner similar to the first embodiment. Consequently, multiple interference occurs by the multiple reflection light, and resonance occurs at a specific wavelength that satisfies a resonance condition. Light of the resonance wavelength is absorbed by the resonance, and the electric field in the substrate is enhanced. Therefore, an electric field enhancement effect can be obtained on the sample contact surface 3*s*. The resonance wavelength changes depending on the average refractive index and the thickness of the transparent member 20 in a manner similar to the first embodiment. Therefore, a high electric field enhancement effect (for example, an enhancement effect of 100 times or more) is obtained at a wavelength appropriate for these factors.

The basic structure of the substrate 3 for mass spectrometry of the present embodiment is similar to the first embodiment except that the first reflective member 10 of the present embodiment includes the metal columnar structure thinfilm. Therefore, the substrate 3 for mass spectrometry of the present embodiment can achieve an effect similar to the first embodiment.

In the present embodiment, a case in which the first reflective member 10 includes the columnar structure thinfilm 17 having the multiplicity of columnar member 17*p* that are substantially parallel to each other and that extend in directions non-parallel to the surface of the transparent member 20, and in which the columnar structure thinfilm 17 is a metal layer has been described. However, it is not necessary that the first reflective member 10 is structured in such a manner.

For example, the first reflective member 10 may include the columnar structure thinfilm 17 and a partially-reflective thinfilm that is semi-transmissive and semi-reflective. The partially-reflective thinfilm may be provided between the columnar structure thinfilm 17 and the transparent member 20. When the first reflective member 10 is structured in such a manner, multiple reflection can more effectively occur in the optical resonator. Examples of the partially-reflective thinfilm are a metal thinfilm, a dielectric multilayered thinfilm, in which a dielectric such as $MgF_2$, $SiO_2$ and $TiO_2$ is deposited.

Alternatively, the first reflective member 10 may include a columnar structure thinfilm that is a dielectric layer and a metal thinfilm formed on the columnar structure thinfilm. When the columnar structure thinfilm is deposited by using an oblique vapor deposition method, it is easier to form the dielectric thin film than forming the metal thinfilm. Further, when the metal thinfilm is deposited on the dielectric thinfilm having columnar structure, the metal thinfilm tends to be deposited along the shape of the columnar member made of the dielectric, and that is desirable. In this case, the metal thinfilm deposited on the dielectric columnar structure thinfilm may have columnar structure or some other structure. In either case, the metal thinfilm is deposited in such a manner that the gaps formed in the columnar structure thinfilm made of the dielectric are substantially maintained. When the columnar structure thinfilm is made of a dielectric, it is desirable that the dielectric is an inorganic material, because the inorganic material is easily deposited, and has an excellent heat-resistant characteristic and light-resistant characteristic. However, if the columnar members can efficiently grow in an organic material, and the organic material is acceptable to the purpose of mass spectrometry, the columnar structure thinfilm may be deposited by using the organic thinfilm. When the organic material is used, the columnar structure thinfilm may be deposited by using a plasma chemical vapor deposition (CVD) method, a molecular beam vapor deposition method (molecular beam epitaxy) or the like.

In the substrate for mass spectrometry of the present embodiment, the first reflective member 10 is structured by the columnar members 17*p* of the columnar structure thinfilm and the gaps 17*s* between the columnar members 17*b*, which form an uneven structure on the surface of the first reflective member. Further, the recess portions (gaps 17*s*) of the uneven structure are continuously connected from a side of the substrate to the opposite side of the substrate. The surface of the substrate on which the uneven structure is provided functions as a sample separation portion. Therefore, an effect similar to the first embodiment can be obtained.

Further, when an organic molecular layer is formed on the surface of the substrate in a manner similar to the first embodiment, it is possible to improve the functions of separation, desorption and ionization, and that is desirable.

Fourth Embodiment of Substrate for Mass Spectrometry

Figure 5A:
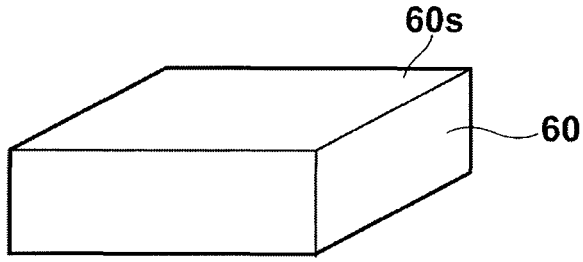
FIG. 5A is a perspective view (No. 1) illustrating the process of producing a substrate for mass spectrometry according to a fourth embodiment of the present invention.
Figure 5B:
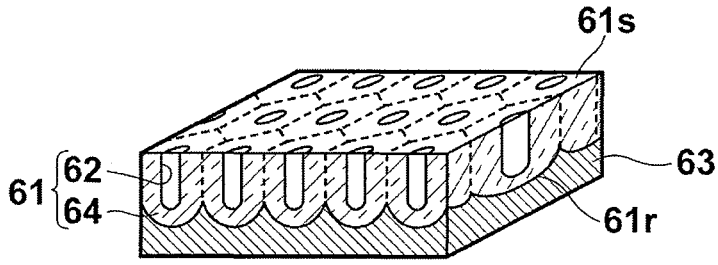
FIG. 5B is a perspective view (No. 2) illustrating the process of producing the substrate for mass spectrometry according to the fourth embodiment of the present invention.
Figure 5C:
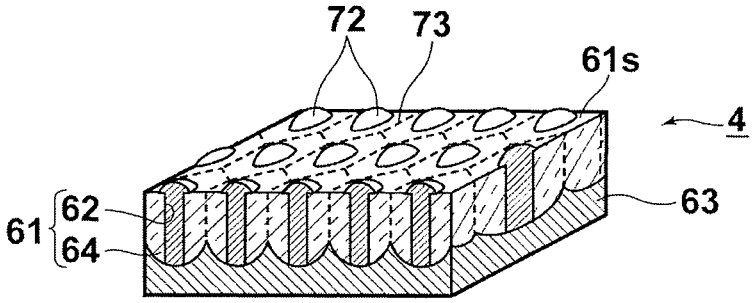
FIG. 5C is a perspective view (No. 3) illustrating the process of producing the substrate for mass spectrometry according to the fourth embodiment of the present invention.
Figure 5D:
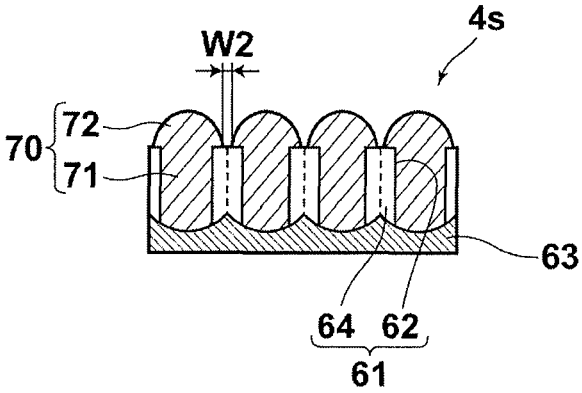
FIG. 5D is a sectional view of the substrate for mass spectrometry according to the fourth embodiment of the present invention in the thickness direction of the substrate.

With reference to FIGS. 5A through 5D, a substrate for mass spectrometry according to a fourth embodiment of the present invention will be described. The substrate for mass spectrometry of the present embodiment differs from the substrates for mass spectrometry of the first through third embodiments in that an optical resonator is not formed in the present embodiment. Further, in the present embodiment, localized plasmons are generated on the surface of the substrate by irradiation with a laser beam, and a hot spot is generated. FIGS. 5A through 5C are perspective views illustrating the process of producing the substrate for mass spectrometry of the present embodiment. FIG. 5D is a sectional view of the substrate for mass spectrometry.

In a substrate 4 for mass spectrometry of the present embodiment, a surface 4*s* is a rough metal surface in which localized plasmons are excited by irradiation with a laser beam, and a hot spot is generated. Further, the rough metal surface includes a sample separation portion at which surface interaction occurs with a plurality of analytes contained in a sample liquid.

As illustrated in FIGS. 5C and 5D, the substrate 4 for mass spectrometry of the present embodiment includes a dielectric base material 61 on an electric conductor 63. The dielectric base material 61 includes a multiplicity of micropores 62 having openings on the surface 61*s* of the dielectric base material 61. The multiplicity of micropores 62 are substantially regularly arranged. Further, the substrate 4 for mass spectrometry includes metal portions 70, each including a filling portion 71 and a projection portion 72. The filling portion 71 fills the micropore 62, and the projection portion 72 is provided on the filling portion 71. The projection portion 72 projects from the surface 61*s* of the dielectric base material 61. The diameter of the projection portion 72 is larger than the diameter of the filling portion 71, and can excite localized plasmons. The substrate 4 for mass spectrometry of the present embodiment differs from the substrate 2 for mass spectrometry of the second embodiment in that the substrate 4 for mass spectrometry of the present embodiment does not have an optical resonance structure, whereas the substrate 2 for mass spectrometry of the second embodiment has an optical resonance structure.

The surface 4*s* of the substrate 4 for mass spectrometry is formed by the projection portions 72 of the metal portions 70 and the surface 61*s* of the dielectric base material 61. Further, an uneven structure is formed on the surface 4*s* by the projection portions 72 and the surface 61*s* of the dielectric base material 61, which are gaps 73 between the projection portions 72. The diameters of the plurality of micropores 71 are smaller than the wavelength of the laser beam L, and the plurality of micropores 71 are substantially regularly arranged at pitches that are smaller than the wavelength of the laser beam L.

In the substrate 4 for mass spectrometry of the present embodiment, the micropore 72 is a through-hole that extends from the surface of the dielectric base material 61 in a direction substantially perpendicular to the surface of the dielectric base material, and reaches the back side 61*r* of the dielectric base material.

As illustrated in FIGS. 5A and 5B, the dielectric base material 61 is an alumina ($Al_2O_3$) layer (metal oxide layer) obtained by anodically oxidizing a part of a metal body 60 to be anodically oxidized. The metal body 60 to be anodically oxidized contains aluminum (Al) as a main component, and may contain a minute amount of impurities. The electric conductor 63 is a non-anodically-oxidized portion of the metal body 60 to be anodically oxidized, which has not been anodically oxidized.

The shape of the metal body 60 to be anodically oxidized is not limited. The shape of the metal body 60 to be anodically oxidized may be a plate form or the like. Further, the metal body 60 to be anodically oxidized may be provided by being attached to a support member. For example, the metal body 60 to be anodically oxidized may be deposited on the support member in layer form.

Anodic oxidization may be performed, for example, by using the metal body 60 to be anodically oxidized as an anode and by using carbon, aluminum or the like as a cathode (counter electrode). The anode and the cathode are soaked in an electrolytic solution for anodic oxidization, and voltage is applied between the anode and the cathode to perform anodic oxidization. The electrolytic solution is not limited. It is desirable to use an acid electrolytic solution containing one kind of acid, or two or more kinds of acid selected from the group consisting of sulfuric acid, phosphoric acid, chromic acid, oxalic acid, sulfamic acid, benzenesulfonic acid, and the like.

When the metal body 60 to be anodically oxidized, illustrated in FIG. 5A, is anodically oxidized, oxidization progresses from the surface 60*s* of the metal body 60 in a direction substantially perpendicular to the surface 60*s*, and the metal oxide ($Al_2O_3$) member 61, as illustrated in FIG. 5B, is produced. The metal oxide member 61 produced by anodic oxidization has a structure in which a multiplicity of micro columnar members 64 are arranged without gaps therebetween. The multiplicity of micro columnar bodies 64 have substantially equilateral hexagon form. Further, a micropore 62 that extends substantially straight in a direction perpendicular to the surface 60*s* is formed substantially at the center of each of the micro columnar members 64, and the bottom of each of the micro columnar bodies 64 is rounded. The structure of the alumina layer produced by anodic oxidization is described in "Preparation of Mesoporous Alumina by Anodic Oxidization and its Application as Functional Material", H. Masuda, Material Technology, Vol. 15, No. 10, pp. 341-346, 1997, and the like.

When the metal oxide member 61 having a regular arrangement structure is produced, desirable anodic oxidization conditions are, for example, as follows. When oxalic acid is used as the electrolytic solution, the concentration of the electrolytic solution is 0.5 M, the liquid temperature is in the range of 14 to 16° C., application voltage is 40 to 40±0.5 V. Ordinarily, the pitches of the micropores 62 next to each other can be controlled in the range of 10 to 500 nm, and the diameters of the micropores 62 can be controlled in the range of 5 to 400 nm, respectively. Meanwhile, Japanese Unexamined Patent Publication No. 2001-009800 and Japanese Unexamined Patent Publication No. 2001-138300 disclose methods for more accurately controlling the formation positions of the micropores and the diameters of the micropores. When these methods are used, it is possible to substantially regularly arrange the micropores that have arbitrary diameters and pitches in the aforementioned ranges. When the aforementioned anodic oxidization condition is adopted to produce the metal oxide member 61, the micropores 62 have diameters of 5 to 200 nm and are arranged at pitches of 10 to 400 nm, for example.

The metal portions 70 having the filling portions 71 and the projection portions 72 are formed by performing electroplating or the like on the micropores 62 in the dielectric base material 61.

When electroplating is performed, the electric conductor 63 functions as an electrode, and metal is preferentially deposited from the bottom of the micropore 62 at which the electric field is strong. When the electroplating is continued, the micropore 62 is filled (loaded) with metal to form the filling portion 71. After the filling portion 71 is formed, electroplating is further continued. Then, the metal that has filled the micropore 62 overflows from the micropore 62. However, since the electric field in the vicinity of the micropore 62 is strong, the metal continues to be deposited in the vicinity of the micropore 62, and the projection portion 72 is formed on the filling portion 71. The projection portion 72 projects from the surface 61*s* of the dielectric base material 61, and the diameter of the projection portion 72 is larger than the diameter of the filling portion 71.

When the metal portion 70 grows by electroplating, a thin layer between the bottom of the micropore 62 and an electric conductor 63, which is formed by a non-anodically-oxidized portion of the metal body 60 to be anodically oxidized, may be broken in some conditions. In such a case, the filling portion 71 of the metal portion 70 may reach the back side 61*r* of the dielectric base material 61, and a structure of the present embodiment is obtained (please refer to FIGS. 5C and 5D).

In the present embodiment, the projection portion 72 of the metal portion 70 is in particle form. When the substrate 4 for mass spectrometry is viewed from the surface-4s-side, a metal particle structure is formed on the surface 61*s* of the dielectric base material 61. In such a structure, the projection portion 72 of the metal portion 70 is a projection. Therefore, an average diameter of the projection portions 72 and an average pitch of the projection portions 72 are designed to be less than the wavelength of the laser beam L. In the metal portion 70, the size of the projection portion 72 should be able to excite localized plasmons. When the wavelength of the laser beam L used in the operation is considered, it is desirable that the diameter of the projection portion 72 is greater than or equal to 10 nm and less than or equal to 300 nm.

Further, it is desirable that the projection portions 72 next to each other are apart from each other in such a manner that localized plasmons generated on the surfaces of the projection portions 72 overlap with each other, and a so-called hot spot is formed. In the hot spot, the localized plasmons enhance each other. It is desirable that an average distance W2 between the adjacent projection portions 72 is in the range of a few nm to 10 nm. When the average distance W2 is in the range of a few nm to 10 nm, it is possible to effectively form the hot spot. In the hot spot, a higher electric field enhancement effect can be obtained, compared with a case in which the localized plasmons are generated independently in each of the projection portions 72 without overlapping.

The substrate 4 for mass spectrometry is used in a mass spectrometry method in a manner similar to the substrates for mass spectrometry of the first through third embodiments of the present invention. In the mass spectrometry method, a sample in contact with a surface of a substrate is irradiated with a laser beam to desorb an analyte contained in the sample from the surface of the substrate. Further, the desorbed analyte is analyzed.

In the substrate 4 for mass spectrometry of the present embodiment, localized plasmons are generated on the surface 4*s* of the substrate 4 by irradiation with a laser beam L, and a hot spot is generated. In the hot spot, the localized plasmons overlap with each other and enhance each other, and an electric field is enhanced. In the hot spot, particularly the energy of the laser beam L is increased, and the analyte is ionized by the increased light energy. Further, it is possible to desorb the analyte from the sample contact surface 4*s*. Specifically, since the energy of the laser beam L is increased by the enhanced electric field on the sample contact surface 4*s*, use of a lower-energy laser beam becomes possible. Hence, it is possible to reduce the cost of the apparatus.

In the substrate for mass spectrometry of the present embodiment, the surface 4*s* of the substrate has an uneven structure. The uneven structure includes the projection portions 72 and gaps 73 between the projection portions 72. The gaps 73 are a surface 61*s* of the dielectric base material 61. Further, the recesses (gaps 73) of the uneven structure are continuously connected from a side of the substrate to the opposite side of the substrate. The surface of the substrate on which the uneven structure is provided functions as a sample separation portion. Therefore, an effect similar to the first embodiment can be obtained.

Further, when an organic molecular layer is formed on the surface of the substrate in a manner similar to the first embodiment, it is possible to improve the functions of separation, desorption and ionization, and that is desirable.

In the fourth embodiment, a case in which the metal oxide member obtained by anodically oxidizing a part of the metal body 60 to be anodically oxidized is the dielectric base material 61, and the non-anodically oxidized portion is the electric conductor 63, and the metal portions 70 are formed by depositing metal in the micropores 62 in the dielectric base material 61 by electroplating has been described. Alternatively, after the whole metal body 60 to be anodically oxidized is anodically oxidized, or after a part of the metal body 60 to be anodically oxidized is anodically oxidized, the non-anodically-oxidized portion and the vicinity thereof may be removed to obtain the dielectric base material 61 having the micropores 62 of through-holes. Further, the electric conductor 63 may be deposited on the dielectric base material 61 by vapor deposition or the like. In this case, the material of the electric conductor 63 is not limited. For example, an arbitrary metal, an electric conductive material, such as ITO (indium tin oxide), or the like may be used.

Here, a case in which the electric conductor 63 is provided on the back side 61*r* of the dielectric base material 61 has been described. However, when a method using an electrode, such as electroplating, is not used to load the metal portion 70 into the micropore 62, it is not necessary that the electric conductor 63 is provided. Further, the electric conductor 63 may be removed after formation of the metal portions 70.

In the present embodiment, a case in which the micropore 62 is a through-hole has been described. However, the micropore 62 may be a non-through hole.

In the present embodiment, only a case in which the main component of the metal body 60 to be anodically oxidized, which is used in production of the dielectric base material 61, is Al has been described. However, it is not necessary that the main component is Al. An arbitrary metal may be used as long as the metal can be anodically oxidized. Metals other than Al are Ti, Ta, Hf, Zr, Si, In, Zn, and the like. The metal body 60 to be anodically oxidized may contain two or more kinds of metals that can be anodically oxidized.

The plan-view pattern of the micropores 62 formed by anodic oxidization differs depending on the type of the metal to be anodically oxidized. Even if the type of the metal is different, the dielectric base material 61 in which micropores 62 having substantially the same shape when being viewed in plane-view direction are arranged next to each other is always obtained.

So far, a case in which the micropores 62 are regularly arranged by using anodic oxidization has been described. However, the method for forming the micropores 62 is not limited to anodic oxidization. The aforementioned embodiments using anodic oxidization are desirable because the entire surface is processed together, and a large area can be processed, and an expensive apparatus is not needed. However, besides the method using the anodic oxidization, a method for forming a plurality of regularly arranged recesses on a substrate of resin or the like by nanoimprinting may be used. Alternatively, the micropores 62 may be formed by using a micro processing technique, such as a method of drawing a plurality of regularly arrange recesses by electronic drawing using a focused ion beam (FIB), an electron beam (EB) or the like.

Fifth Embodiment of Substrate for Mass Spectrometry

Figure 6:
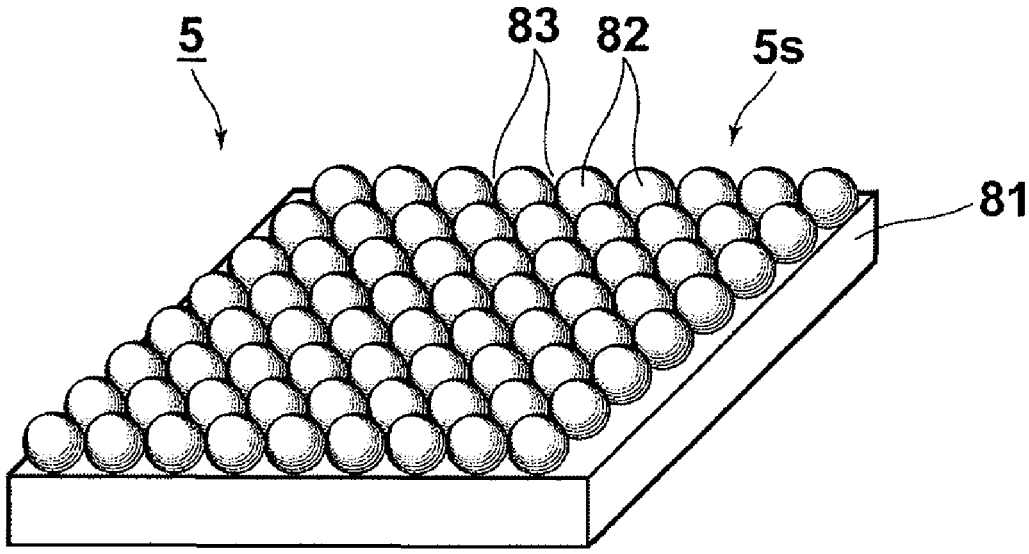
FIG. 6 is a perspective view of a substrate for mass spectrometry according to a fifth embodiment of the present invention.

With reference to FIG. 6, a substrate for mass spectrometry according to a fifth embodiment of the present invention will be described. In the substrate for mass spectrometry of the present embodiment, localized plasmons are generated on a surface of the substrate by irradiation with a laser beam and a hot spot is generated in a manner similar to the substrate for mass spectrometry of the fourth embodiment. FIG. 6 is a perspective view of the substrate for mass spectrometry of the present embodiment.

As illustrated in FIG. 6, a substrate 5 for mass spectrometry of the present embodiment is a substrate in which a plurality of metal particles 82 are fixed, in array form, onto a flat dielectric 81. The metal particles 82 form a rough metal surface on the surface 5*s* of the substrate 5. The arrangement pattern of the metal particles 82 may be designed in an appropriate manner, and it is desirable that the arrangement is substantially regular. In such a structure, an uneven structure is formed by the metal particles 82 and gaps 83 between the metal particles 82. Further, the average diameter of the metal particles 82 and the pitch of the uneven pattern are designed smaller than the wavelength of the laser beam L. When the surface having the uneven structure is irradiated with the laser beam L, localized plasmons are excited, and a hot spot is generated. The intervals of the metal particles are approximately in the range of a few nm to 10 nm. The metal particles are arranged to be apart from each other by a distance that can generate a hot spot between the metal particles when localized plasmons are excited on the surfaces of the metal particles.

In the substrate 5 for mass spectrometry of the present embodiment, localized plasmons are generated on the surface 5*s* of the substrate 5 by irradiation with the laser beam L, and a hot spot is generated. In the hot spot, the localized plasmons are overlapped with each other, and enhance each other in a manner similar to the fourth embodiment. Therefore, an electric field is enhanced, and it is possible to achieve an advantageous effect similar to the fourth embodiment.

In the substrate 5 for mass spectrometry of the present embodiment, the surface 5*s* of the substrate 5 is formed by an uneven structure including the metal particles 82 and gaps 83 between the metal particles 82. Further, the recesses (gaps 83) of the uneven structure are continuously connected from a side of the substrate to the opposite side of the substrate. The surface of the substrate on which the uneven structure is provided functions as a sample separation portion. Therefore, an effect similar to the first embodiment can be obtained.

Further, when an organic molecular layer is formed on the surface of the substrate in a manner similar to the first embodiment, it is possible to improve the functions of separation, desorption and ionization, and that is desirable.

Sixth Embodiment of Substrate for Mass Spectrometry

Figure 7:
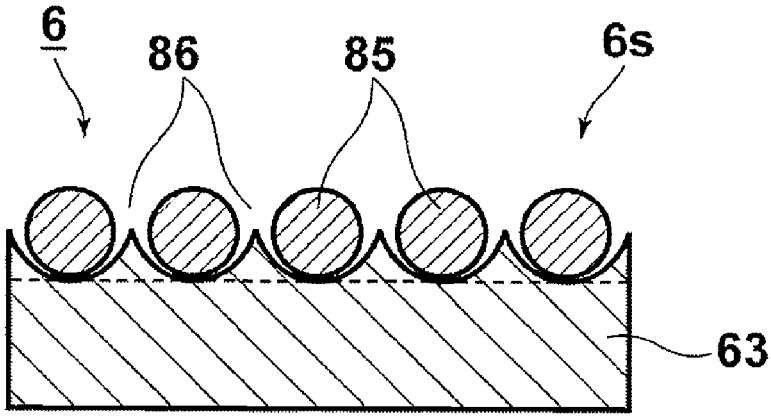
FIG. 7 is a sectional view of a substrate for mass spectrometry according to a sixth embodiment of the present invention in the thickness direction of the substrate.

With reference to FIG. 7, a substrate for mass spectrometry according to a sixth embodiment of the present invention will be described. In the substrate for mass spectrometry of the present embodiment, localized plasmons are generated by irradiation with a laser beam and a hot spot is generated in a manner similar to the substrates for mass spectrometry of the fourth and fifth embodiments. FIG. 7 is a sectional view of the substrate for mass spectrometry of the present embodiment.

A substrate 6 for mass spectrometry illustrated in FIG. 6 includes a non-anodically-oxidized portion 63 of a metal body to be anodically oxidized. The non-anodically-oxidized portion 63 is obtained by performing anodic oxidization on the metal body 60 to be anodically oxidized to form the alumina layer 61, as illustrated in FIGS. 5A and 5B, and by removing the alumina layer 61. Further, metal particles are arranged in a plurality of dimple-form recesses on the surface of the non-anodically-oxidized portion 63.

This structure can be obtained by depositing a metal layer along the uneven pattern on the surface of the non-anodically-oxidized portion 63 (in such a manner to follow the shape of the uneven pattern), and by annealing the metal layer to form particles (please refer to European Patent Application Publication No. 2053383).

In the substrate 6 for mass spectrometry of the present embodiment, localized plasmons are generated on the surface 6*s* of the substrate by irradiation with the laser beam L, and a hot spot is generated. In the hot spot, the localized plasmons are overlapped with each other, and enhance each other in a manner similar to the fourth embodiment. Therefore, an electric field is enhanced, it is possible to achieve an advantageous effect similar to the fourth embodiment.

In the substrate 6 for mass spectrometry of the present embodiment, the surface 6*s* of the substrate 6 is formed by an uneven structure including the metal particles 85 and gaps 86 between the metal particles 85. Further, the recesses (gaps 86) of the uneven structure are continuously connected from a side of the substrate to the opposite side of the substrate. The surface of the substrate on which the uneven structure is provided functions as a sample separation portion. Therefore, an effect similar to the first embodiment can be obtained.

Further, when an organic molecular layer is formed on the surface of the substrate in a manner similar to the first embodiment, it is possible to improve the functions of separation, desorption and ionization, and that is desirable.

<Mass Spectrometry Method>

The steps of a mass spectrometry method according to an embodiment of the present invention will be described. The method uses a substrate for mass spectrometry of the present invention. Here, a case of using the substrate 1 for mass spectrometry according to the first embodiment of the present invention will be described. When the substrates 2 through 6 for mass spectrometry according to the second through sixth embodiments of the present invention are used, mass spectrometry may be performed in a similar manner to the case of using the substrate 1 for mass spectrometry according to the first embodiment, and similar advantageous effects are achieved.

First, a surface modification layer and/or a desorption/ionization-inducing layer are formed on a sample separation portion of a substrate for mass spectrometry.

Figure 8A:
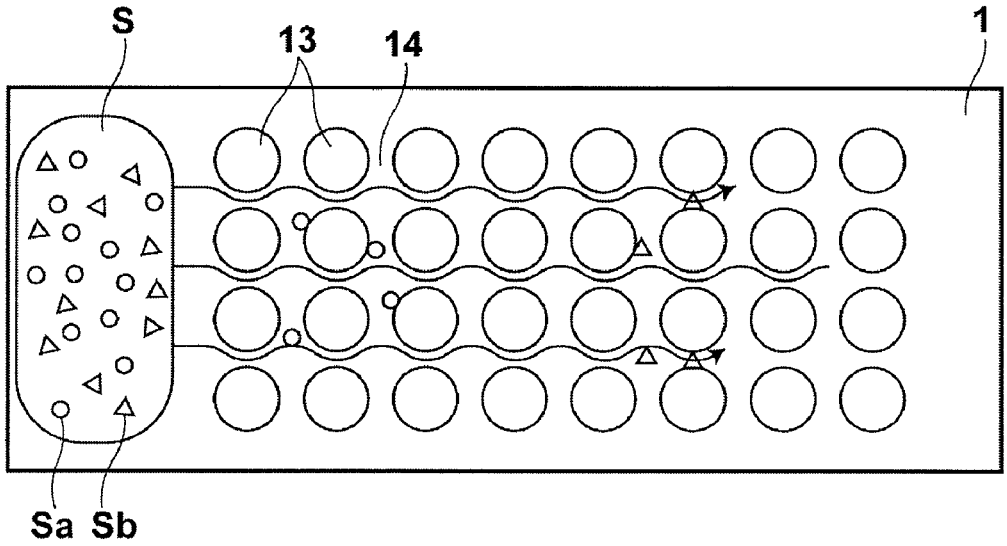
FIG. 8A is a plan view illustrating separation of a sample on a substrate for mass spectrometry.
Figure 8B:
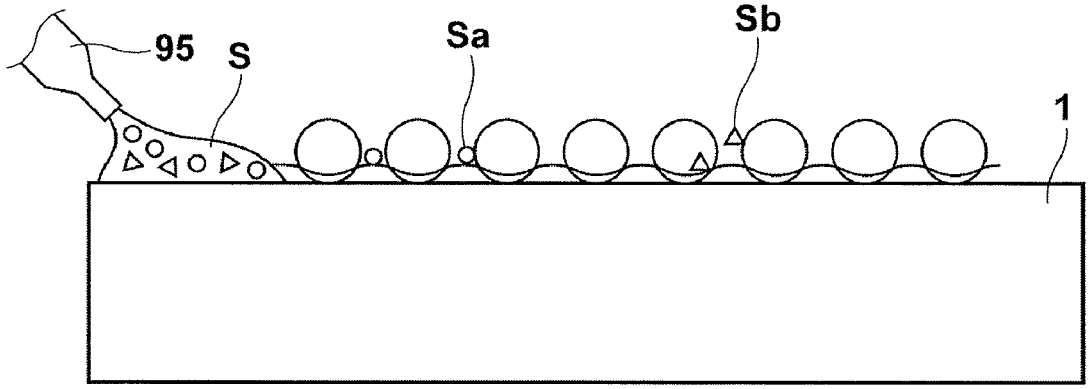
FIG. 8B is a sectional view illustrating separation of the sample on the substrate for mass spectrometry.
Figure 9A:
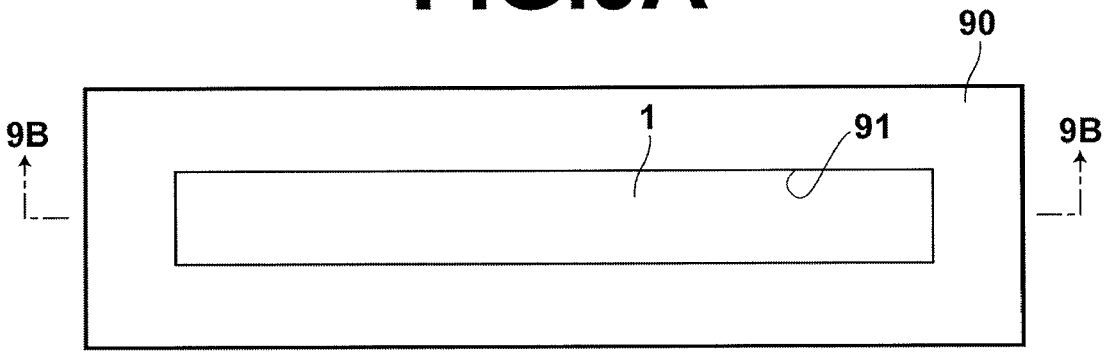
FIG. 9A is a plan view illustrating a way of using a substrate for mass spectrometry.
Figure 9B:
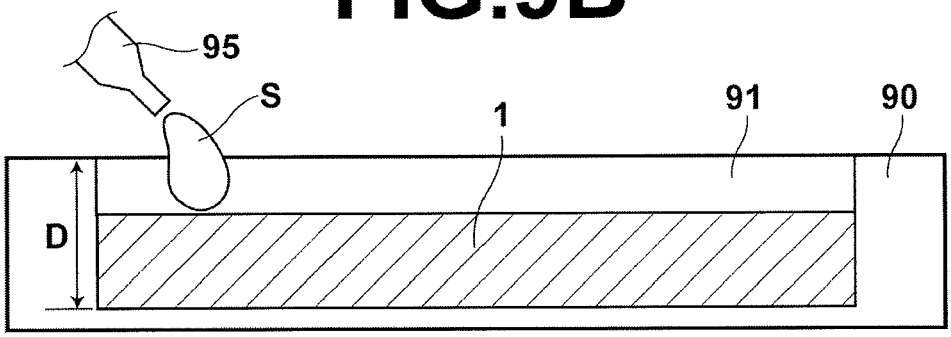
FIG. 9B is a sectional view illustrating away of using the substrate for mass spectrometry.

As illustrated in FIGS. 8A and 8B, sample liquid S is dropped onto the substrate 1 for mass spectrometry by using a pipette 95 or the like to make the sample liquid S flow (permeate or spread) from a side of the sample separation portion to the opposite side of the sample separation portion (from the left side to the right side of FIGS. 8A and 8B).

The sample liquid S contains a plurality of analytes Sa, Sb. The velocity of the movement of the analyte Sa that has high affinity for the surface of the sample separation portion is relatively low, and the velocity of the movement of the analyte Sb that has low affinity for the surface of the sample separation portion is relatively high. Therefore, the sample liquid S is gradually separated, while the sample liquid S moves along recesses (gaps) 14 of the uneven structure provided on the surface of the substrate. When a predetermined time period has passed after dropping the sample liquid S, a substrate in which the plurality of analytes are separated, in the permeation direction of the sample liquid S, to different positions of the sample separation portion having the uneven structure is obtained.

A mass spectrometry apparatus 100, which will be described later, is used to perform mass spectrometry. Laser beam L is output to the substrate 1 on which the plurality of analytes are separated to different positions A, B from each other, as illustrated in FIG. 10, to ionize the analytes and to desorb the analytes from the sample separation portion. The desorbed ionized substance is captured to perform mass spectrometry.

As a method for outputting the laser, if the irradiation position of the laser is gradually moved from the sample dropped portion of the substrate (sample analysis substrate) in the permeation direction of the sample, it is possible to desorb and ionize each of the separated analytes independently, and to detect the analytes. In this method, it is possible to suppress the influence of interference and inhibition between substances that have different ionization efficiencies from each other. Further, it is possible to prevent loss of the analytes in mass spectrometry. Therefore, it is possible to improve the accuracy of identifying an unknown compound and to improve the sensitivity of detecting an unknown/known compound. Further, it is possible to improve the accuracy of quantitative analysis of a known compound.

Further, in this method, if the relationship between a separation condition and the distance of movement is obtained in advance for each analyte, the accuracy of identifying the analyte and the accuracy of quantitative analysis of the analyte can be improved by using the distance of movement. Alternatively, an internal standard substance the distance of movement of which and the mass of which are known may be mixed into the sample solution. The accuracy of identifying the analyte and the accuracy of quantitative analysis of the analyte can be improved based on the relationship with the internal standard substance.

Instead of continuously irradiating the sample analysis substrate without a break or space, as described above, only predetermined areas or spots of the sample analysis substrate may be irradiated. When irradiation is performed in such a manner, it is possible to detect only an intended substance or substances, and detection is performed in a short time period.

As described above, the substrate 1 for mass spectrometry can generate an extremely-high enhanced electric field on the surface of the substrate 1. Therefore, the energy of the laser beam is increased, and the efficiency of ionizing and desorbing the analytes can be improved. Further, as described in the aforementioned embodiments of the substrates for mass spectrometry, it is possible to use a low-power laser beam, as the laser beam output to the substrate. Hence, it is possible to prevent damage to the analytes and to reduce the cost of the light source.

When the surface 1*s* of the substrate 1 for mass spectrometry is hydrophobic, if the solvent of the sample is water, the sample does not permeate into the gaps, and the sample is not sufficiently separated. Therefore, it is desirable that the sample is mixed with an organic solvent, or dissolved in the organic solvent in advance, and the mixture or solution is dropped onto the substrate to separate the analytes. Specifically, it is desirable to select a solvent that has high polarity and high volatility, such as acetonitrile, propionitrile, THF (tetrahydrofuran), methanol (methyl alcohol), ethanol (ethyl alcohol), isobutanol, and tertiary butanol (tertiary butyl alcohol). Further, in some cases, the sample may be separated first, and only the solvent may be spread on the same sample separation portion to improve the degree of separation of the sample.

As described above, the separation phenomenon occurs by interaction between the surface of the sample separation portion and the analytes. Therefore, if the condition of the surface of the sample separation portion differs, the separation pattern of the analytes differs. In some cases, even if the degree of separation of a plurality of analytes on a certain surface is low and insufficient, the plurality of analytes may be separated at an excellent degree of separation on another surface. Therefore, if a plurality of kinds of substrates that have different surfaces from each are used by providing different organic molecular layers, and mass spectrometry is performed on the same sample liquid by using the plurality of kinds of substrates, it is possible to improve the accuracy of identifying an unknown compound and to improve the sensitivity of detecting an unknown/known compound. Further, it is possible to improve the accuracy of quantitative analysis of a known compound.

[Mass Spectrometry Apparatus]

Figure 11:
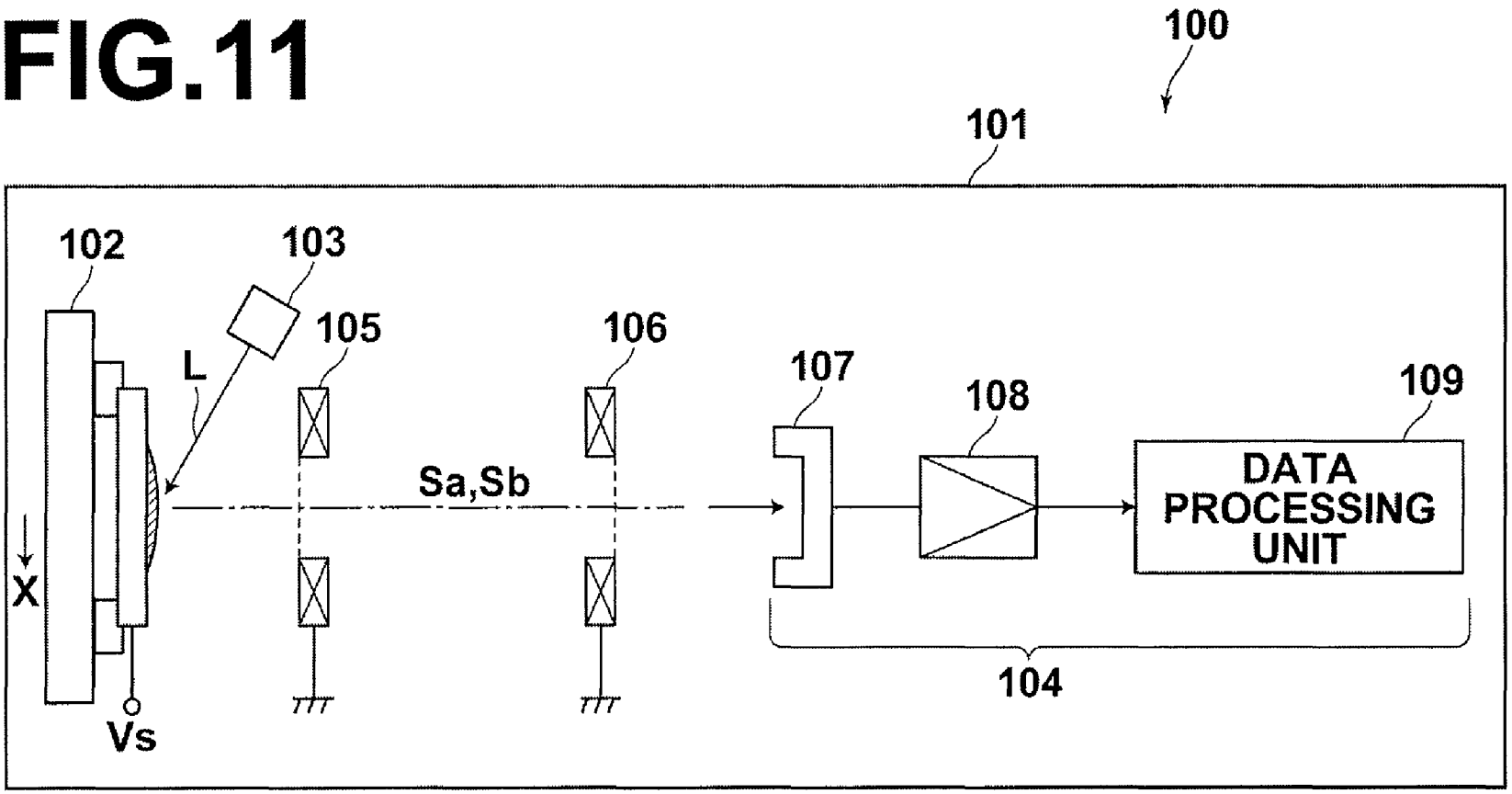
FIG. 11 is a schematic diagram illustrating the structure of an embodiment of a mass spectrometry apparatus.

With reference to FIG. 11, an embodiment of a mass spectrometry apparatus for performing mass spectrometry will be described. The mass spectrometry apparatus of the present embodiment is time-of-flight mass spectrometry (TOF-MS) apparatus. FIG. 11 is a schematic diagram illustrating the configuration of a mass spectrometry apparatus 100 of the present embodiment.

As illustrated in FIG. 11, the mass spectrometry apparatus 100 includes the substrate 1 for mass spectrometry according to any one of the aforementioned embodiments, a stage 102, a light irradiation means 103, and an analysis means 104 in a box 101 the inside of which is a vacuum. The stage 102 includes a substrate holding means that holds the substrate 1 for mass spectrometry. The light irradiation means 103 irradiates a sample in contact with a surface 1*s* of a first reflective member 10 of the substrate 1 for mass spectrometry with laser beam L to desorb analytes Sa, Sb from the surface 1*s* of the first reflective member 10. The analysis means 104 detects the desorbed analytes Sa, Sb, and analyzes the mass of the analytes Sa, Sb. Further, the mass spectrometry apparatus 100 includes an extraction grid 105 and an endplate 106. The extraction grid 105 is arranged between the substrate 1 for mass spectrometry and the analysis means 104 so as to face the surface 1*s* of the first reflective member 10. The end plate 106 is arranged so as to face a surface of the extraction grid 105, the surface being opposite to the substrate 1 for mass spectrometry.

The stage 102 is a movable stage that can move the substrate 1 for mass spectrometry placed on the stage 102 at least in one direction (direction X in FIG. 11). The stage 102 can move a plurality of positions on the substrate 1 for mass spectrometry, at which different analytes are placed, to a laser irradiation position.

The light irradiation means 103 may include a laser source and a light guide system, such as a mirror, that guides light output from the laser source. The light source may be, for example, a pulsed laser source that outputs laser beams having a wavelength of 337 nm and a pulse width of approximately 50 ps to 50 ns.

The analysis means 104 substantially includes a detection unit 107, an amplifier 108 and a data processing unit 109. The detection unit 107 detects analytes Sa, Sb that have been desorbed from the surface of the first reflective member 10 of the substrate 1 for mass spectrometry by irradiation with the laser beam L and that have flown to the detection unit 107 to the analysis unit 107 through a center hole of the extraction grid 105 and a center hole of the end plate 106. The amplifier 108 amplifies an output from the detection unit 107. The data processing unit 109 processes a signal output from the amplifier 108.

Next, mass spectrometry using the apparatus 100 for mass spectrometry configured as described above will be described.

Mass spectrometry will be performed on a plurality of analytes Sa, Sb present at separate positions on the substrate 1 for mass spectrometry. First, a sample liquid is dropped onto the substrate 1 for mass spectrometry, and the substrate 1 for mass spectrometry on which the plurality of analytes are separated is placed on the stage 102. At this time, the substrate 1 for mass spectrometry is placed in such a manner that the direction of the movement of the stage 102 and the permeation direction of the sample on the sample separation portion of the substrate for mass spectrometry become the same. Further, the position of the substrate 1 for mass spectrometry is adjusted so that the vicinity of position A at which the first analyte Sa is fixed is irradiated with the laser beam.

Voltage Vs is applied to the substrate 1 for mass spectrometry. The light irradiation means 103 irradiates, based on a predetermined start signal, a surface 1*s* at position A of the substrate 1 for mass spectrometry with laser beam L having a specific wavelength. The electric field on the surface 1*s* of the substrate 1 for mass spectrometry is enhanced by irradiation with the laser beam L. Further, the light energy of the laser beam L is enhanced by the enhanced electric field, and the analyte Sa in the sample is ionized by the enhanced light energy, and desorbed from the surface 1*s*. Here, the analyte Sa may be desorbed from the surface 1*s* after ionization. Alternatively, the analyte Sa may be ionized after being desorbed from the surface 1*s*.

The desorbed analyte Sa is extracted (drawn) toward the direction of the extraction grid 105 by electric potential difference between the substrate 1 for mass spectrometry and the extraction grid 105, and accelerated. Further, the analyte Sa moves through the center hole of the extraction grid 105, and flies substantially straight toward the direction of the end plate 106. The analyte Sa passes through a hole of the end plate 106, and reaches the detection unit 107 to be detected.

The output signal from the detection unit 107 is amplified by the amplifier 108 to a predetermined level, and input to the data processing unit 109. A synchronous signal that synchronizes with the start signal has been input to the data processing unit 109. Therefore, the data processing unit 109 can calculate the time period of flight of the analyte Sa based on the synchronous signal and the output signal from the amplifier 108. Hence, it is possible to produce the mass spectrum by calculating the mass based on the time period of flight.

In the present embodiment, a case in which all of the aforementioned elements are provided in the box 101 has been described. However, it is not necessary that all of the elements are provided in the box 101. It is sufficient if only the substrate 1 for mass spectrometry, the extraction grid 105, the end plate 106 and the detection unit 107 are placed in the box 101.

In the present embodiment, a case in which the mass spectrometry apparatus 100 is a TOF-MS apparatus has been described. However, the apparatus that performs mass spectrometry on ionized sample ions is not limited to the TOF-type apparatus. Alternatively, IT (ion trap: ion trapping type), FT (ICR) (Fourier-Transform Ion Cyclotron Resonance Fourier transformation type), or the like may be used. Further, an apparatus, such as Qq-TOF (quadrupole-TOF type) and TOF-TOF (TOF-TOF tandem type), which combines a plurality of mass spectrometry methods, may be used.

In the substrates for mass spectrometry in the first through sixth embodiments of the present invention, the electric fields on the surfaces of the substrates are effectively enhanced. Therefore, the substrates for mass spectrometry of the first through sixth embodiments may be adopted as sensor plates utilizing the electric field enhancement effects on the surfaces of the substrates. For example, a surface enhanced Raman active substrate (SERS active substrate) is a substrate for Raman spectrometry that can perform high-sensitivity sensing by increasing the intensity of weak Raman scattered light on the sample contact surface by the electric field enhancement effect. Therefore, the substrates 1 through 6 for mass spectrometry may be adopted as the SERS active substrates. For example, mass spectrometry may be performed after presence and position of the analyte for mass spectrometry are detected by performing sensing by Raman spectrometry. Further, when the Raman spectrum information is used together with mass information and distance-of-movement information, the accuracy of identifying the substance is improved.

What is claimed is:

1. A substrate for mass spectrometry used in a mass spectrometry method in which a substance fixed on a surface of the substrate is irradiated with a laser beam to be ionized and to be desorbed from the surface, and the ionized substance is captured to perform mass spectrometry, the substrate comprising:

a first reflective member that is semi-transmissive and semi-reflective;

a transparent member; and a second reflective member that is reflective, wherein the first reflective member, the transparent member and the second reflective member are sequentially provided from the surface side of the substrate to form an optical resonator that generates resonance in the transparent member by irradiation of a surface of the first reflective member with the laser beam, and wherein the optical resonator includes, on the surface of the first reflective member, a sample separation portion at which surface interaction occurs with a plurality of analytes contained in a sample liquid.

2. A substrate for mass spectrometry, as defined in claim 1, wherein the first reflective member has, at least on the surface of the first reflective member, an uneven structure including projections and recesses that are smaller than the wavelength of the laser beam, and wherein the recesses of the uneven structure are continuously connected from a side of the sample separation portion to the opposite side of the sample separation portion.

3. A substrate for mass spectrometry, as defined in claim 1, wherein the first reflective member is a metal layer that generates localized plasmons by irradiation with the laser beam.

4. A substrate for mass spectrometry, as defined in claim 3, wherein the first reflective member is a metal layer including a multiplicity of non-cohesive metal particles fixed onto a surface of the transparent member.

5. A substrate for mass spectrometry, as defined in claim 3, wherein the transparent member is a transparent microporous member including a multiplicity of micropores that have openings on a first-reflective-member-side surface of the transparent member and that have diameters smaller than the wavelength of the laser beam, and wherein the transparent microporous member is loaded with metal micro-particles in such a manner that projection portions of the metal micro-particles, the projection portions being larger than the diameters of the multiplicity of micropores, project from the surface of the transparent microporous member, and wherein the first reflective member is a metal layer including the projection portions.

6. A substrate for mass spectrometry, as defined in claim 3, wherein the first reflective member is the metal layer including a multiplicity of columnar members that are substantially parallel to each other, and each of which extends in a direction that is not parallel to a surface of the transparent member.

7. A substrate for mass spectrometry, as defined in claim 1, wherein the sample separation portion is coated with an organic molecular layer including a surface modification layer that provides a desirable surface property and/or a desorption/ionization-inducing layer that accelerates desorption of an analyte attached to the sample separation portion from the sample separation portion and/or that accelerates ionization of the analyte.

8. A substrate for mass spectrometry, as defined in claim 7, wherein the thickness of the organic molecular layer is greater than or equal to 0.3 nm and less than or equal to 50 nm.

9. A substrate for mass spectrometry, as defined in claim 7, wherein the thickness of the surface modification layer is greater than or equal to 0.3 nm and less than or equal to 3 nm.

10. A substrate for mass spectrometry, as defined in claim 7, wherein the surface modification layer is a self-assembled monolayer.

11. A substrate for mass spectrometry, as defined in claim 10, wherein the self-assembled monolayer includes a compound containing a thiol.

12. A substrate for mass spectrometry, as defined in claim 7, wherein the desorption/ionization-inducing layer includes a compound containing a disiloxane.

13. Amass spectrometry method, wherein a substrate for mass spectrometry including a first reflective member that is semi-transmissive and semi-reflective, a transparent member, and a second reflective member that is reflective is used, and wherein the first reflective member, the transparent member and the second reflective member are sequentially provided to form an optical resonator that generates resonance in the transparent member by irradiation of a surface of the first reflective member with a laser beam, and wherein the optical resonator includes, on the surface of the first reflective member, a sample separation portion at which surface interaction occurs with a plurality of analytes contained in a sample liquid, the method comprising the steps of:

making the sample liquid that contains the plurality of analytes flow down from a side of the sample separation portion to the opposite side of the sample separation portion on the substrate for mass spectrometry to separate the plurality of analytes so as to be present at different positions from each other on the sample separation portion;

irradiating each of the plurality of separated analytes on the sample separation portion with a laser beam sequentially to ionize each of the analytes and to desorb each of the analytes from the sample separation portion; and capturing each of the ionized analytes to perform mass spectrometry.

14. A mass spectrometry method, as defined in claim 13, wherein the sample liquid flows down after the plurality of analytes are dissolved into an organic solvent or mixed with the organic solvent to obtain the sample liquid.

15. A mass spectrometry method, as defined in claim 13, wherein mass spectrometry is performed on the sample liquid by using a plurality of substrates for mass spectrometry that have different organic molecular layers from each other.

16. A substrate for mass spectrometry used in a mass spectrometry method in which a substance fixed on a surface of the substrate is irradiated with a laser beam to be ionized and to be desorbed from the surface, and the ionized substance is captured to perform mass spectrometry, wherein the surface of the substrate is a rough metal surface that excites localized plasmons by irradiation with a laser beam and that generates a hot spot, and wherein the rough metal surface has a sample separation portion at which surface interaction occurs with a plurality of analytes contained in a sample liquid.

17. A substrate for mass spectrometry, as defined in claim 16, wherein the rough metal surface has an uneven structure including projections and recesses that are smaller than the wavelength of the laser beam on a surface of metal, and wherein the recesses of the uneven structure are continuously connected from a side of the sample separation portion to the opposite side of the sample separation portion.

18. A substrate for mass spectrometry, as defined in claim 17, further comprising:

a dielectric base material, wherein the rough metal surface includes a multiplicity of non-cohesive metal particles fixed onto a surface of the dielectric base material.

19. A substrate for mass spectrometry, as defined in claim 17, further comprising:

a dielectric base material, wherein the rough metal surface includes metal micro-particles loaded into a multiplicity of micropores that are formed on a surface of a transparent member in such a manner that projection portions of the metal micro-particles, the projection portions being larger than the diameters of the multiplicity of micropores, project from the surface of the dielectric base material.

20. A substrate for mass spectrometry, as defined in claim 16, wherein the sample separation portion is coated with an organic molecular layer including a surface modification layer that provides a desirable surface property and/or a desorption/ionization-inducing layer that accelerates desorption of an analyte attached to the sample separation portion from the sample separation portion and/or that accelerates ionization of the analyte.

21. A substrate for mass spectrometry, as defined in claim 20, wherein the thickness of the organic molecular layer is greater than or equal to 0.3 nm and less than or equal to 50 nm.

22. A substrate for mass spectrometry, as defined in claim 20, wherein the thickness of the surface modification layer is greater than or equal to 0.3 nm and less than or equal to 3 nm.

23. A substrate for mass spectrometry, as defined in claim 20, wherein the surface modification layer is a self-assembled monolayer.

24. A substrate for mass spectrometry, as defined in claim 23, wherein the self-assembled monolayer includes a compound containing a thiol.

25. A substrate for mass spectrometry, as defined in claim 20, wherein the desorption/ionization-inducing layer includes a compound containing a disiloxane.

26. Amass spectrometry method, wherein a substrate for mass spectrometry having a rough metal surface that excites localized plasmons by irradiation with a laser beam and that generates a hot spot is used, and wherein the rough metal surface has a sample separation portion at which surface interaction occurs with a plurality of analytes contained in a sample liquid, the method comprising the steps of:

making the sample liquid containing the plurality of analytes flow from a side of the sample separation portion to the opposite side of the sample separation portion on the substrate for mass spectrometry to separate the plurality of analytes to different positions from each other on the sample separation portion;

irradiating each of the plurality of separated analytes on the sample separation portion with a laser beam sequentially to ionize each of the analytes and to desorb each of the analytes from the sample separation portion; and capturing each of the ionized analytes to perform mass spectrometry.

27. A mass spectrometry method, as defined in claim 26, wherein the sample liquid flows down after the plurality of analytes are dissolved into an organic solvent or mixed with the organic solvent to obtain the sample liquid.

28. A mass spectrometry method, as defined in claim 26, wherein mass spectrometry is performed on the sample liquid by using a plurality of substrates for mass spectrometry that have different organic molecular layers from each other.

* * * * *